US010271154B2

(12) United States Patent
Bocko

(10) Patent No.: US 10,271,154 B2
(45) Date of Patent: Apr. 23, 2019

(54) SYSTEMS AND METHODS FOR AUDIO SCENE GENERATION BY EFFECTING SPATIAL AND TEMPORAL CONTROL OF THE VIBRATIONS OF A PANEL

(71) Applicant: Mark F. Bocko, Caledonia, NY (US)

(72) Inventor: Mark F. Bocko, Caledonia, NY (US)

(73) Assignee: The University of Rochester, Rochester, NY (US)

( * ) Notice: Subject to any disclaimer, the term of this patent is extended or adjusted under 35 U.S.C. 154(b) by 0 days.

(21) Appl. No.: 15/778,797

(22) PCT Filed: Nov. 21, 2016

(86) PCT No.: PCT/US2016/063121

§ 371 (c)(1),
(2) Date: May 24, 2018

(87) PCT Pub. No.: WO2017/091509

PCT Pub. Date: Jun. 1, 2017

(65) Prior Publication Data

US 2018/0359590 A1 Dec. 13, 2018

Related U.S. Application Data

(60) Provisional application No. 62/259,702, filed on Nov. 25, 2015.

(51) Int. Cl.
*H04R 1/28* (2006.01)
*H04R 3/00* (2006.01)
(Continued)

(52) U.S. Cl.
CPC ..... *H04S 7/30* (2013.01); *H04R 1/2811* (2013.01); *H04R 3/00* (2013.01); *H04R 5/04* (2013.01);
(Continued)

(58) Field of Classification Search
CPC ... H04R 5/04; H04R 5/02; H04R 7/04; H04R 3/00; H04R 1/2811; H04R 2499/11; H04R 2499/15
See application file for complete search history.

(56) References Cited

U.S. PATENT DOCUMENTS

2014/0140551 A1* 5/2014 Ramstein ..... H04R 17/005 381/182
2017/0180855 A1* 6/2017 Lee ..... H04R 3/04

FOREIGN PATENT DOCUMENTS

WO 2008/090077 A1 7/2008
WO WO 2008/090077 A1 * 7/2008
WO 2015/119612 A1 8/2015

OTHER PUBLICATIONS

Anderson et al., A Model for the Impulse Response of Distributed-Mode Loudspeakers and Multi-Actuator Panels, Oct. 29, 2015 AES Conference Paper 9409 http://www.aes.org/tmpFiles/elib/20181105/17966.pdf.*

(Continued)

*Primary Examiner* — Yogeshkumar Patel
(74) *Attorney, Agent, or Firm* — Meunier Carlin & Curfman LLC

(57) ABSTRACT

A loudspeaker system composed of a flexible panel with an affixed array of force actuators, a signal processing system, and interface electronic circuits is described. The system described is capable of creating a pattern of standing bending waves at any location on the panel and the instantaneous amplitude, velocity, or acceleration of the standing waves can be controlled by an audio signal to create localized acoustic sources at the selected locations in the plane of the panel.

20 Claims, 28 Drawing Sheets

(51) Int. Cl.

| | |
|---|---|
| ***H04R 5/04*** | (2006.01) |
| ***H04R 7/04*** | (2006.01) |
| ***H04R 7/00*** | (2006.01) |
| ***H04S 7/00*** | (2006.01) |

(52) U.S. Cl.
CPC ..... *H04R 7/045* (2013.01); *H04R 2440/01* (2013.01); *H04R 2440/05* (2013.01); *H04R 2499/15* (2013.01)

(56) References Cited

OTHER PUBLICATIONS

Anderson, D. et al. A Model for the Impulse Response of Distributed-Mode Loudspeakers and Multi-Actuator Panels:, AES Convention 139, Oct. 2015, 10 pages.
International Search Report and Written Opinion dated Feb. 14, 2017, from International Application No. PCT/US2016/063121, 15 pages.

* cited by examiner $$a_0 f(n) = b_0 a(n) + b_1 a(n-1) + b_2 a(n-2) - a_1 f(n-1) - a_2 f(n-2) \quad (335)$$

$$a_0 F = (b_0 + b_1 z^{-1} + b_2 z^{-2}) A - (a_1 z^{-1} + a_2 z^{-2}) F \quad (340)$$

$$F = \frac{(b_0 + b_1 z^{-1} + b_2 z^{-2})}{(a_0 + a_1 z^{-1} + a_2 z^{-2})} A \quad (350)$$

INDIVIDUAL ELECTRODE CONFIGURATION

COMMON GROUND PLANE CONFIGURATION

ISOLATED ELECTRODE CONFIGURATION

WAVE FIELD SYNTHESIS
(RECREATE SOUND FIELD WITH 2D
ARRAY OF SECONDARY SOURCES)

BIND AUDIO SOURCES
TO IMAGES

STEREOPHONIC - SURROUND
LEFT - RIGHT - CENTER

CONSTRUCTION OF PIEZO-ACTUATED OLED DISPLAY

SYSTEMS AND METHODS FOR AUDIO SCENE GENERATION BY EFFECTING SPATIAL AND TEMPORAL CONTROL OF THE VIBRATIONS OF A PANEL

CROSS-REFERENCE TO RELATED APPLICATIONS

This application is a 371 application of International Application Number PCT/US2016/063121, filed Nov. 21, 2016, which claims priority to, and the benefit of, U.S. Provisional Application No. 62/259,702, filed Nov. 25, 2016, titled "SYSTEMS AND METHODS FOR AUDIO SCENE GENERATION BY EFFECTING SPATIAL AND TEMPORAL CONTROL OF THE VIBRATIONS OF A PANEL," each of which is incorporated by reference herein in its entirety.

BACKGROUND

Loudspeakers that employ bending mode vibrations of a diaphragm or plate to reproduce sound were first proposed at least 90 years ago. The design concept reappeared in the 1960's when it was commercialized as the "Natural Sound Loudspeaker," a trapezoidal shaped, resin-Styrofoam composite diaphragm structure driven at a central point by a dynamic force transducer. In the description of that device, the inventors identified the "multi-resonance" properties of the diaphragm and emphasized that the presence of higher-order modes increased the efficiency of sound production. The Natural Sound Loudspeaker was employed in musical instrument and hi-fi speakers marketed by Yamaha, Fender, and others but it is rare to find surviving examples today. Similar planar loudspeaker designs were patented around the same time by Bertagni and marketed by Bertagni Electroacoustical Systems (BES).

The basic concept of generating sound from bending waves in plates was revisited by New Transducers Limited in the late 1990's and named the "Distributed-Mode Loudspeaker" (DML). Further research on the mechanics, acoustics, and psychoacoustics of vibrating plate loudspeakers illuminated many of the issues of such designs and provided design tools for the further development of the technology, which remains commercially available from Redux Sound and Touch, a descendant of the original New Transducers Limited by Sonance, which can be traced back to the original BES Corporation in the 1970's, and by others including Tectonic Audio Labs and Clearview Audio.

One physical feature of vibrating panel loudspeakers is the presence of a multiplicity of under-damped mechanical modes of vibration. In contrast, a pistonic loudspeaker can have a single degree of freedom and can be heavily damped, which makes its dynamic response simple in comparison to that of vibrating panel loudspeakers. To address this, panel loudspeaker designs employing wood-polymer composite structures to reduce the ring-down time of excited panel bending modes have been described. Without careful mechanical design measures, the presence of under-damped bending modes in panel loudspeakers can degrade audio quality.

Therefore, what are needed are devices, systems and methods that overcome challenges in the present art, some of which are described above.

SUMMARY

Disclosed herein are systems and methods that describe ways to achieve high quality audio reproduction in a wide range of panel materials and designs. The systems and methods employ a frequency crossover network in combination with an array of force drivers to enable selective excitation of different panel mechanical modes. This system allows different frequency bands of an audio signal to be reproduced by selected mechanical modes of a panel. For example, it may be preferable to avoid driving low-frequency panel modes, which can have long ring-down times by high-frequency audio components. Rather it can be desirable to employ the higher panel modes for reproduction of high frequency audio components. This "modal crossover" technique can avoid transient distortions that are present in vibrating panel loudspeakers and dramatically improve audio quality.

The systems and methods for driving selected bending modes of a panel with an array of force driving elements also enables a higher degree of control over the spatial distribution of transverse panel vibrations. This, in turn, can allow a greater degree of spatial control of the sound generated by the panel, both the apparent locations of acoustic sources in the plane of the panel and the spatial distribution of the radiated sound.

In one aspect, a method of effecting spatial and temporal control of the vibrations of a panel is disclosed. The method comprises receiving a shape function and an audio signal; determining a band-limited Fourier series representation of the shape function; computing one or more modal accelerations from the audio signal and the band-limited Fourier series representation of the shape function; computing one or more modal forces needed to produce the one or more modal accelerations, wherein the computing of the one or more modal forces comprises using a frequency domain plate-bending mode response; determining a response associated with a discrete-time filter corresponding to the frequency domain plate bending mode response; summing the one or more modal forces to determine a force required at each driver element in a plurality of driver elements; performing a multichannel digital to analog conversion and amplification of one or more forces required at each driver element in the plurality of driver elements; and driving a plurality of amplifiers with the converted and amplified forces required at each driver element in the plurality of driver elements.

In another aspect, a system for spatial and temporal control of the vibrations of a panel is disclosed. The system comprises a functional portion of an display; (with backlight, polarizing material layer, and color filter layer); an audio layer comprising a plate and a plurality of driver elements; (with a shield layer, a piezoelectric film layer, electrodes, and a cover glass for protection), wherein the function portion of the display is proximate to the audio layer; a processor and a memory; wherein the processor is configured to run computer-generated code to: receive a shape function and an audio signal; determine a band-limited Fourier series representation of the shape function; compute one or more modal accelerations from the audio signal and the band-limited Fourier series representation of the shape function; compute one or more modal forces needed to produce the one or more modal accelerations, wherein the computing of the one or more modal forces comprises using a frequency domain plate bending mode response; determine a response associated with a discrete-time filter corresponding to the frequency domain plate bending mode response; sum the one or more modal forces to find one or more forces required at each driver element in a plurality of driver elements; perform a multichannel digital-to-analog conversion and amplification of the a force required at each driver element in a plurality of driver elements; and drive a plurality of amplifiers with the converted and amplified forces required at each driver element in the plurality of driver elements.

In yet another aspect, a method of virtual source generation for the generation of an audio scene by effecting spatial and temporal control of the vibrations of a panel is disclosed. The method comprises receiving an audio signal; receiving one or more distance cues associated with a virtual acoustic source, wherein the virtual acoustic source is representative of an acoustic source behind a panel; computing one or more acoustic wave fronts at one or more predetermined locations on the panel; computing one or more modal accelerations from the audio signal and one or more distance ques and acoustic wave fronts; computing one or more modal forces needed to produce the one or more modal accelerations, wherein the computing of the one or more modal forces comprises using a frequency domain plate bending mode response; determining a response associated with a discrete-time filter corresponding to the frequency domain plate bending mode response; summing the one or more modal forces to determine one or more forces required at each driver element in an array of driver element; performing a multichannel digital-to-analog conversion and amplification of the a force required at each driver element in an array of driver elements; and driving a plurality of amplifiers with the converted and amplified forces required at each driver element in an array of driver elements.

In another aspect, a system for spatial and temporal control of the vibrations of a panel is disclosed. The system comprises a projector; a plurality of drive elements mounted to the backside of a panel; reflective screen facing the projector; a processor and memory, wherein the processor is configured to run computer-generated code to: receive a shape function and an audio signal; determine a band-limited Fourier series representation of the shape function; compute one or more modal accelerations from the audio signal and the Fourier series representation of the shape function; compute one or more modal forces needed to produce the one or more modal accelerations, wherein the computing of the one or more modal forces comprises using a frequency domain plate bending mode response; determine a response associated with a discrete-time filter corresponding to the frequency domain plate bending mode response; sum the one or more modal forces to determine a force required at each driver element in a plurality of driver elements; perform a multichannel digital to analog conversion and amplification of one or more forces required at each driver element in a plurality of driver elements; and drive a plurality of amplifiers with the converted and amplified forces required at each driver element in a plurality of driver elements.

Additional advantages will be set forth in part in the description which follows or may be learned by practice. The advantages will be realized and attained by means of the elements and combinations particularly pointed out in the appended claims. It is to be understood that both the foregoing general description and the following detailed description are exemplary and explanatory only and are not restrictive, as claimed.

BRIEF DESCRIPTION OF THE DRAWINGS

The accompanying drawings, which are incorporated in and constitute a part of this specification, illustrate embodiments and together with the description, serve to explain the principles of the methods and systems:

FIG. 6 shows the left and right channels.

FIG. 7 shows the left, right, and center channels.

FIG. 8 shows the left and right channels.

FIG. 9 shows the left, right, and center channels.

FIG. 12A represents a dynamic force actuator, and FIG. 12B represents a piezoelectric in-plane actuator.

FIG. 18A shows the panel vibrations being controlled to produce the left, right and center channels in a for a surround sound application. FIG. 18B shows the audio sources being bound to a portion of a video or image associated with a display. FIG. 18C shows how the composite wavefronts at the plane of the display from an array of secondary audio sources would be synthesized by the audio display using wave field synthesis to simulate a virtual acoustic source.

FIG. 28, comprising

DETAILED DESCRIPTION

Figure 1:
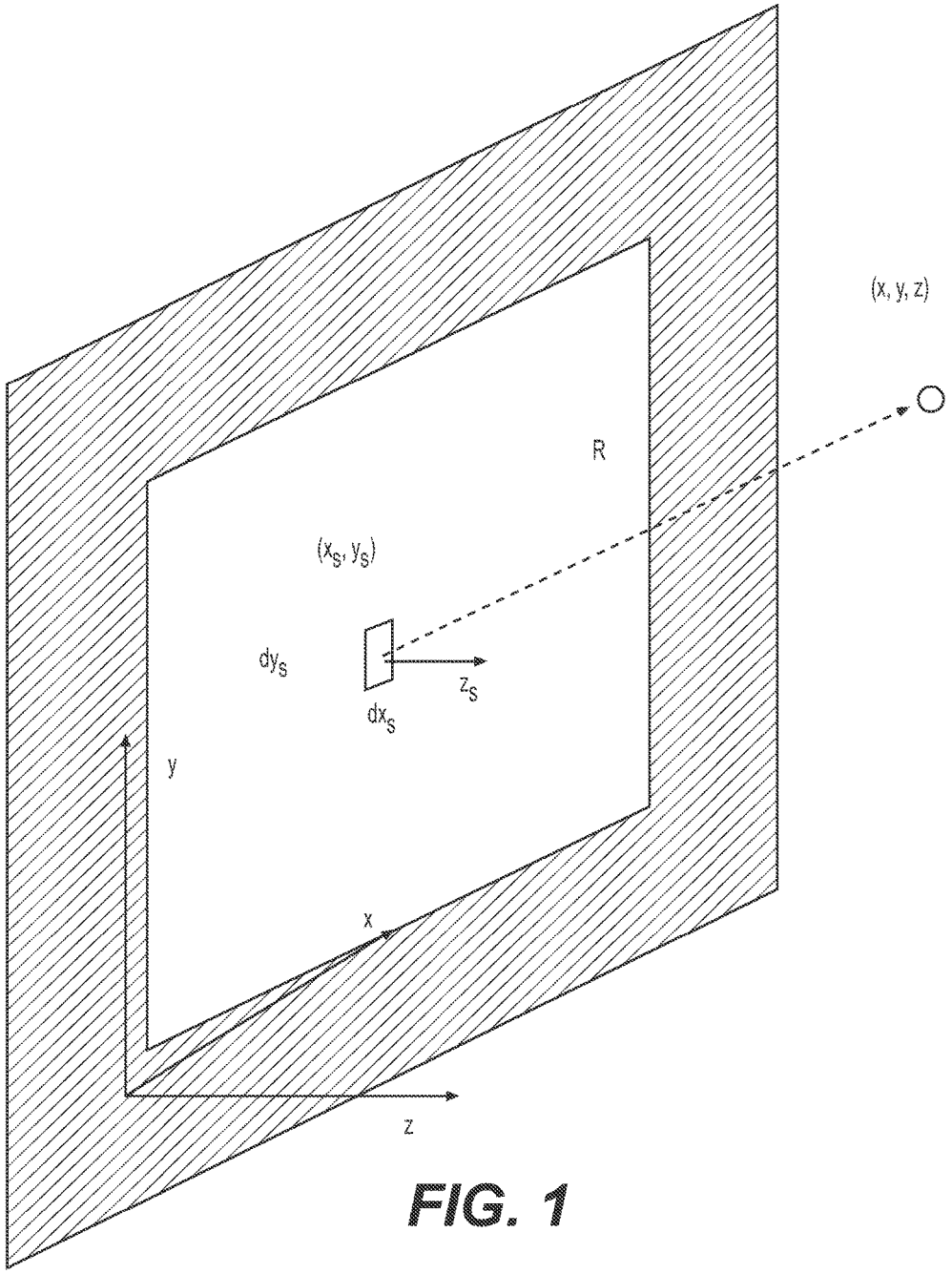
FIG. 1 shows the coordinate definitions for the Rayleigh integral in accordance with the disclosed systems and methods.

Before the present methods and systems are disclosed and described, it is to be understood that the methods and systems are not limited to specific synthetic methods, specific components, or to particular compositions. It is also to be understood that the terminology used herein is for the purpose of describing particular embodiments only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes—from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and systems may be understood more readily by reference to the following detailed description of preferred embodiments and the Examples included therein and to the Figures and their previous and following description.

As will be appreciated by one skilled in the art, the methods and systems may take the form of an entirely hardware embodiment, an entirely software embodiment, or an embodiment combining software and hardware aspects. Furthermore, the methods and systems may take the form of a computer program product on a computer-readable storage medium having computer-readable program instructions (e.g., computer software) embodied in the storage medium. More particularly, the present methods and systems may take the form of web-implemented computer software. Any suitable computer-readable storage medium may be utilized including hard disks, CD-ROMs, optical storage devices, or magnetic storage devices.

Embodiments of the methods and systems are described below with reference to block diagrams and flowchart illustrations of methods, systems, apparatuses and computer program products. It will be understood that each block of the block diagrams and flowchart illustrations, and combinations of blocks in the block diagrams and flowchart illustrations, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create a means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including computer-readable instructions for implementing the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and computer instructions.

Background and Theory

Disclosed herein are systems and methods that describe effecting spatial and temporal control of the vibrations of a panel, which in turn can enable control of the radiated sound. The Rayleigh integral can be employed to compute the sound pressure $p(\vec{x},t)$ measured at a point in space $\vec{x}$, distant from the panel, $$p(\vec{x}, t) = \frac{\rho}{2\pi}\int\int_s \frac{\ddot{z}_s(x_s, y_s, t - R/c)}{R} dx_s dy_s \tag{1}$$

where $\ddot{z}_s(x_s,y_s,t-R/c)$ is the acceleration of the panel normal to its surface at a point $(x_s,y_s)$ in the plane of the panel, R is the distance from $(x_s,y_s)$ to a point in space, $\vec{x}=(x,y,z)$, at which the sound pressure is measured, ρ is the density of air, and c is the speed of sound in air. FIG. 1 shows the coordinate definitions for the Rayleigh integral of (1). Note that $(x_s,y_s)$ is used to refer to points on the panel surface and $z_s$ is the displacement of the panel normal to its surface. The panel is assumed to be placed in an infinite baffle so the integral need only extend over the front surface of the panel.

It is possible to have multiple sound sources distributed in the plane of the panel and due to the linearity of the Rayleigh integral, these may be treated independently. However, if different sources overlap spatially there exists the potential for intermodulation distortion, which also may be present in conventional loudspeakers. This may not have a large effect but it can be avoided altogether by maintaining spatial separation of different sound sources, or by spatially separating low frequency and high frequency audio sources.

The collection of sources may be represented by a panel acceleration function $\ddot{z}_s(x_s,y_s,t)$ that can be factored into functions of space, $a_{0,k}(x_s,y_s)$ and functions of time, $s_k(t)$. The sum of the individual sources, assuming that there are K sources, gives the overall panel acceleration normal to its surface:

$$\ddot{z}_s(x_s, y_s, t) = \sum_{k=1}^{K} a_{0,k}(x_s, y_s)\, s_k(t). \tag{2}$$

In the following a single audio source is considered so the subscript k is left off. Thus, $$\ddot{z}_s(x_s,y_s,t)=a_0(x_s,y_s)s(t), \tag{3}$$

where $a_0(x_s,y_s)$ is the "shape function" corresponding to the desired spatial pattern of the panel vibrations.

The shape function may be a slowly changing function of time, e.g., an audio source may move in the plane of the audio display. If the audio source is assumed to be moving slowly, both in comparison to the speed of sound and to the speed of the propagation of bending waves in the surface of the plate, then in the moving source case $a_0(x_s,y_s,t)$ can be a slowly varying function of time. The rapid, audio-frequency, time dependence can then be represented by the function s(t). This is analogous to the well-known rotating-wave approximation. However, to keep matters simple in following discussion $a_0(x_s,y_s)$ is treated as time-independent.

Any shape function can be represented by its two-dimensional Fourier series employing the panel's bending normal modes as the basis functions. In practice, the Fourier series representation of a panel's spatial vibration pattern will be band-limited. This means that there can be a minimum (shortest) spatial wavelength in the Fourier series. To force the panel to vibrate (in time) in accordance with a given audio signal, s(t), while maintaining a specified shape function can require that the acceleration of each normal mode in the Fourier series follow the time dependence of the audio signal. Each of the panel normal modes may be treated as an independent, simple harmonic oscillator with a single degree-of-freedom, which may be driven by an array of driver elements (also interchangeably referred to as force actuators herein). The driver elements can be distributed on the panel to drive the acceleration of each mode, making it follow the audio signal s(t). A digital filter for computing the modal forces from the audio signal is derived below as well.

To independently excite each panel normal mode can require the collective action of the array of driver elements distributed on the panel. The concept of modal drivers where each panel normal mode may be driven independently by a linear combination of individual driver elements in the array will be discussed in more detail below. A review of the bending modes of a rectangular panel is first provided.

Normal Modes and Mode Frequencies of a Rectangular Plate

It is assumed that the panel comprises a rectangular plate with dimensions $L_x$ and $L_y$ in the x and y directions. The equation governing the bending motion of a plate of thickness h may be found from the fourth-order equation of motion:

$$D\nabla^4 z + \rho h\frac{\partial^2 z}{\partial t^2} + b\frac{\partial z}{\partial t} = 0 \tag{4}$$

in which D is the plate bending stiffness given by, $$D = \frac{Eh^3}{12(1-\nu^2)}. \tag{5}$$

In the above equation, b is the damping constant (in units of Nt/(m/sec)/m$^2$), E is the elastic modulus of the plate material (Nt/m$^2$), h is the plate thickness (m), ρ is the density of the plate material (kg/m$^3$), and ν is Poisson's ratio for the plate material. When the edges of the plate are simply supported, the normal modes are sine waves that go to zero at the plate boundaries. The normalized normal modes are given by, $$\varphi_{mn}(x_s,y_s)=2\sin(m\pi x_s/L_x)\sin(n\pi y_s/L_y). \tag{6}$$

The normalization of the modes can be such that, for a plate of uniform mass density throughout, $$\int_0^{L_x} dx_s \int_0^{L_y} dy_s\, \rho h\, \varphi_{mn}(x_s, y_s)\, \varphi_{rs}(x_s, y_s) = M\delta_{mr}\delta_{ns}; \tag{7}$$

$$\delta_{mr} = \begin{cases} 0 & \text{if } m \neq r \\ 1 & \text{if } m = r \end{cases}$$

where M is the total mass of the plate, $M=\rho hL_xL_y=\rho hA$, where $A=L_xL_y$ is the plate area.

The speed of propagation of bending waves in a plate may be found from (4). Ignoring damping for the moment, the solution of (4) shows that the speed of propagation of a bending wave in the plate is a function of the bending wave frequency, f:

$$c = \left[2\pi f\left(\frac{D}{\rho h}\right)^{1/2}\right]^{1/2}. \tag{8}$$

This expression may be rewritten as, $$c = c_0\left(\frac{f}{f_0}\right)^{1/2} \tag{9}$$

where $c_0$ is the bending wave speed at a reference frequency $f_0$.

As an example, Aluminosilicate glass has the following physical parameters: $E=7.15\times10^{10}$ Nt/m$^2$, $\nu=0.21$, and $\rho=2.45\times10^3$ kg/m$^3$ (all values approximate). Assuming a panel thickness of approximately 0.55 mm, $c_0=74.24$ m/sec at $f_0=1000$ Hz (all values approximate), the bending wave speed can then be found at any frequency using (9).

For example, considering an approximately 20,000 Hz bending wave traversing a panel at a speed of about 332 m/sec; the wavelength of an approximately 20 kHz bending wave (the upper limit of the audio range) is then $\nu=c/f=0.0166$ m (1.66 cm). To excite an approximately 20 kHz bending wave in the plate, the Nyquist sampling criterion requires that there be two force actuators per spatial wavelength. In this example the force actuator array spacing required to drive modes at approximately 20 kHz would be about 0.8 cm. It can be possible to drive lower frequency modes above their resonant frequencies to generate high frequency sound radiation; however, if the force actuator spacing is larger than the spatial Nyquist frequency for the highest audio frequency there can be uncontrolled high frequency modes.

The frequency of the (m,n) mode is given by, $$f_{m,n} = \frac{c}{2}\left(\left(\frac{m}{L_x}\right)^2 + \left(\frac{n}{L_y}\right)^2\right)^{1/2}; \tag{10}$$

however, since the speed of a bending wave is frequency dependent substituting (9) into (10) this can be rewritten as, $$f_{m,n} = \frac{c_0^2}{4f_0}\left(\left(\frac{m}{L_x}\right)^2 + \left(\frac{n}{L_y}\right)^2\right). \tag{11}$$

Equations (6) and (11) give the mode shapes and mode frequencies for the normal modes of a rectangular plate with simply supported edges.

Control of the Panel Shape Function

The truncated two-dimensional Fourier series using the panel normal modes as the basis functions provides a spatially band-limited representation of a panel shape function, $$a_0(x_s, y_s) = \sum_{m=1}^{M}\sum_{n=1}^{N} a_{mn}\ \varphi_{mn}(x_s, y_s), \tag{12}$$

where $a_{mn}$ is the amplitude of the (m,n) panel normal mode. As discussed above, the Fourier series is truncated at an upper limit (M,N) which can determine the spatial resolution in the plane of the panel of the shape function. A specific shape function can be created on the plate and then be amplitude modulated with the audio signal. According to the Rayleigh integral, (1), the acoustic sound pressure is proportional to the normal acceleration of the plate, so the acceleration of each mode follows the time-dependence of the audio signal, $$\ddot{u}_{mn}(t)=a_{mn}s(t). \tag{13}$$

To find the equation of motion for the mode amplitudes, the plate normal displacement can be first written in terms of time dependent mode amplitudes, $$z(x_s, y_s, t) = \sum_{m,n} u_{mn}(t)\ \sin(m\pi x_s/L_x)\ \sin(n\pi y_s/L_y)e^{j\omega t}. \tag{14}$$

This can then be substituted into the equation for the bending motion of a plate with an applied force:

$$D\nabla^4 z(x_s, y_s, t) + \rho h\frac{\partial^2 z(x_s, y_s t)}{\partial t^2} + b\frac{\partial z(x_s, y_s, t)}{\partial t} = P(x_s, y_s, t) \tag{15}$$

where $P(x_s,y_s,t)$ is the normal force per unit area acting on the plate. The force can also be expanded in a Fourier series:

$$P(x_s, y_s, t) = \sum_{m,n} p_{mn}\ \sin(m\pi x_s/L_x)\ \sin(n\pi y_s/L_y)e^{j\omega t}. \tag{16}$$

Substituting into the equation of motion, equation (15), the frequency domain plate response function is:

$$U_{mn}(\omega) = \frac{1}{\rho h}\left(\frac{1}{\omega_{mn}^2 - \omega^2 + j\frac{\omega\omega_{mn}}{Q_{mn}}}\right)P_{mn}(\omega) \tag{17}$$

where $U_{mn}(\omega)$ and $P_{mn}(\omega)$ are the frequency domain normal mode amplitude and the force per unit area acting on the mode, $\omega_{mn}=2\pi f_{mn}$ is the angular frequency of the (m,n) mode, and $Q_{mn}=\omega_{mn}M/b$ is the quality factor of the (m,n) plate mode. This can be re-written in terms of the force acting on the (m,n) mode, $F_{mn}(\omega)=AP_{mn}(\omega)$, as $$U_{mn}(\omega) = \frac{1}{\rho hA}\left(\frac{1}{\omega_{mn}^2 - \omega^2 + j\frac{\omega\omega_{mn}}{Q_{mn}}}\right)F_{mn}(\omega). \tag{18}$$

To find the discrete time filter equivalent for this system, the system response can be represented in the Laplace domain (where $j\omega\rightarrow s$) and a bilinear transformation can be employed to transform to the z-domain. Because the force required to give a target modal acceleration is desired, (18) can be re-written in the Laplace domain and rearranged to find the force required to achieve a target modal acceleration, $$F_{mn}(s) = \left(\frac{s^2 + s\frac{\omega_{mn}}{Q_{mn}} + \omega_{mn}^2}{s^2}\right) MA_{mn}(s), \tag{19}$$

where $A_{mn}(s)=s^2U_{mn}(s)$, and $M=\rho hA$ is the panel mass as before. Then, making the substitution $$s = \frac{2}{T}\frac{z-1}{z+1},$$

using T for the discrete time sampling period, the z-domain system response can be defined by $$F_{mn}(z)=H_{mn}(z)A_{mn}(z). \tag{20}$$

The system response is second order and may be written as, $$H_{mn}(z) = \frac{b_0 + b_1 z^{-1} + b_2 z^{-2}}{a_0 + a_1 z^{-1} + a_2 z^{-2}} \tag{21}$$

where the coefficients are given by the following expressions. Note that the mode number notation in the coefficients can be suppressed, but there is a unique set of coefficients for each mode:

$$\begin{aligned} a_0 &= 1 & b_0 &= M\left(1 + \frac{\omega_{mn}}{Q_{mn}}\frac{T}{2} + \omega_{mn}^2\frac{T^2}{4}\right) \\ a_1 &= -2 & b_1 &= M\left(-2 + \omega_{mn}^2\frac{T^2}{4}\right) \\ a_2 &= 1 & b_2 &= M\left(1 - \frac{\omega_{mn}}{Q_{mn}}\frac{T}{2} + \omega_{mn}^2\frac{T^2}{4}\right) \end{aligned} \tag{22}$$

The system then may be represented by a second order, infinite impulse response filter as follows, $$a_0 f(k)=b_0 a(k)+b_1 a(k-1)+b_2 a(k-2)-a_1 f(k-1)-a_2 f(k-2) \tag{23}$$

where f(k) represents the discrete time sampled modal force and a(k) is the discrete time sampled target modal acceleration; once again the (m,n) mode indices are suppressed to unclutter the notation.

One aspect of the above filter is that the system transfer function as defined in (21) and (22) has a pair of poles at z=1, and thus diverges at zero frequency. That is, the force required to produce a static acceleration goes to infinity. Since the audio frequency range is of interest, and it does not extend below 20 Hz, the problem can be addressed by introducing a high-pass filter into the system response. In practice this can be achieved simply by replacing the two poles at z=1 with a complex conjugate pair of poles slightly off the real axis and inside of the unit circle.

Application of Modal Forces

The last step is to find the individual forces that must be applied by the force actuator array to obtain the required modal drive forces. Assuming that there is a set of force actuators distributed on the plate at locations, $\{x_r, y_s\}$ where r=1 . . . R, and s=1 . . . S. There are R actuators in the x-dimension and S actuators in they-dimension, and because rectangular plates are being considered, R and S will be, in general, different. The total discrete time force that should be applied at each actuator location $(x_r, y_s)$ is given by, $$f(x_r, y_s, k) = \sum_{m,n} f_{mn}(k)\, \varphi_{mn}(x_r, y_s). \tag{24}$$

In the notation introduced $f(x_r, y_s, k)$ refers to the force applied at location $(x_r, y_s)$ at the discrete time k. This can be computed by summing over the modal contributions, $f_{mn}(k)$, each one weighted by the (m,n) normal mode amplitude at the location $(x_r, y_s)$ on the plate.

The preceding discussion is a general description of the computational steps required to effect spatial and temporal control of a plate employing an array of force actuators coupled to the plate. The method is summarized in the flowchart of FIG. 2, with reference to specific equations in the above analysis.

Figure 2:
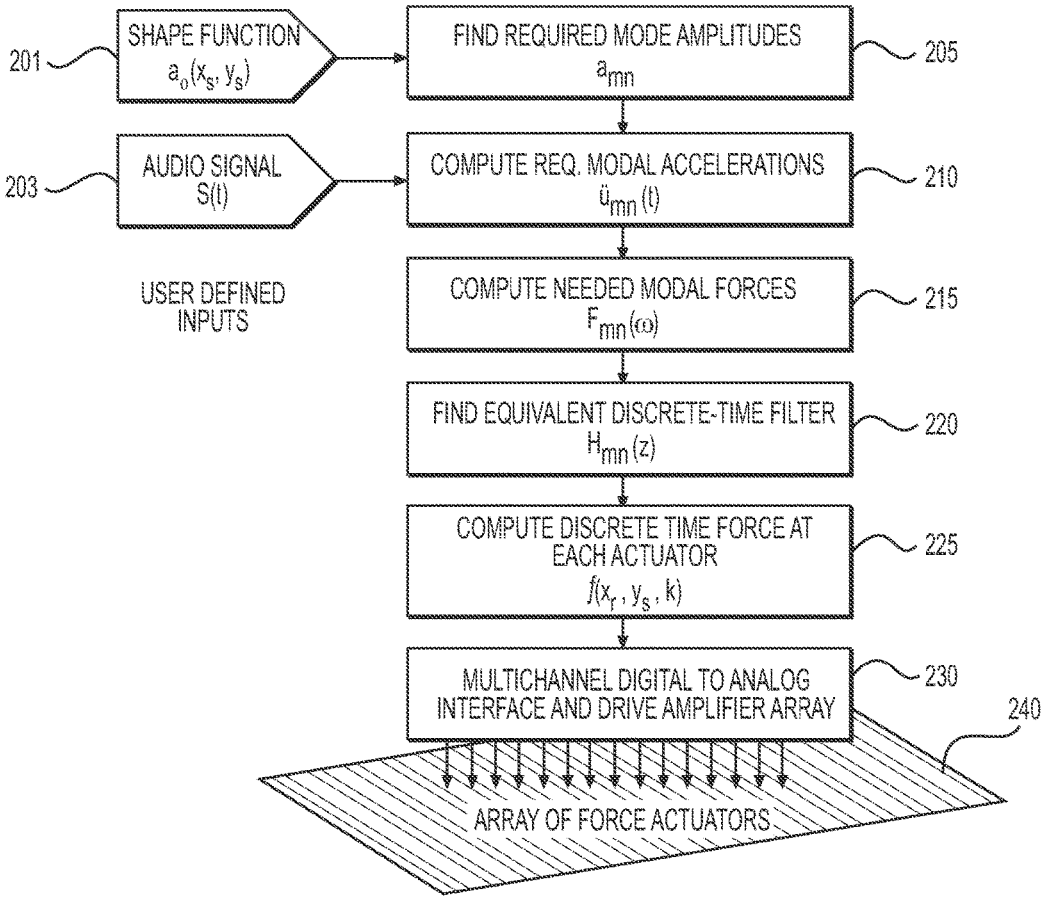
FIG. 2 shows a flowchart detailing the steps in the computation of the drive signals for each driver element in an array of driver elements to achieve control of the spatial and temporal vibrations of a plate panel.

Broadly speaking, as indicated in FIG. 2, a user inputs the audio signal to be reproduced and the desired shape function, which gives the intended spatial distribution of panel vibrations. The output of the computational steps is the discrete-time signal that must be applied to each driver element (e.g. force actuator) in the array of driver elements to achieve the desired shape function and temporal plate response. The final output of the system is a multi-channel analog signal that is used to drive each of the driver elements in the array.

More specifically, first, in 201 and 203, a shape function and an audio signal is received; next, a band-limited Fourier series representation of the shape function 205 is determined. Next, one or more modal accelerations from the audio signal and the band-limited Fourier series representation of the shape function 210 are computed. Then, one or more modal forces needed to produce the one or more modal accelerations 215 is computed. The computation of the one or more modal forces can include using a frequency domain plate-bending mode response. Next, a response associated with a discrete-time filter corresponding to the frequency domain plate bending mode response 220 is determined. The one or more modal forces to determine a force required at each driver element in a plurality of driver elements 225 is summed. Finally, a multichannel digital to analog conversion and amplification of one or more forces required at each driver element in the plurality of driver elements 230, and drive a plurality of amplifiers with the converted and amplified electrical signals required at each driver element in the plurality of driver elements 240 is performed.

Figure 3:
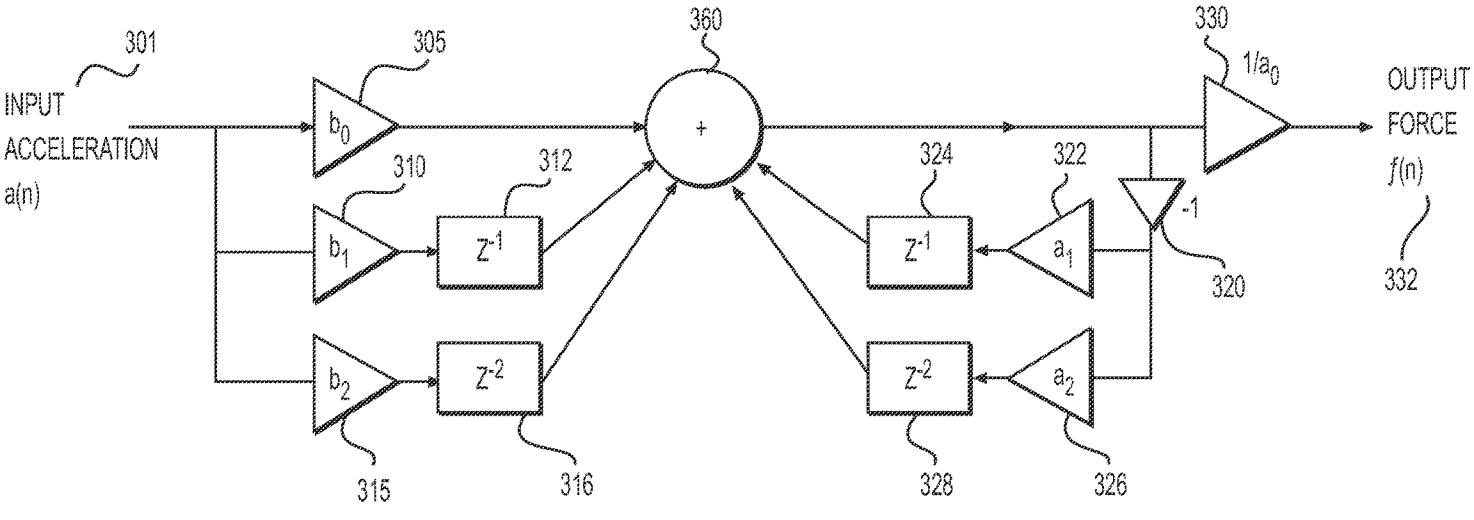
FIG. 3 represents a flow diagram of the implementation of the discrete-time filter that enables the computation of the required modal force to achieve a target acceleration for a given plate mode.

FIG. 3 represents a flow diagram of the implementation of the discrete-time filter corresponding to the bending mode response $H_{mn}(z)$. In 301 the acceleration a(n) in inputted into the filter. The input is then differentially multiplied by coefficients $b_0$, $b_1$, and $b_2$ (305, 310, and 315), and delayed by elements 312 and 316, and summed in 360. The output of the summing node (360)) is also multiplied by coefficients $a_1$ and $a_2$, and then delayed by elements 324 and 328. This quantity is subtracted from the summed portion in the previous step. The processed input is then multiplied by $1/a_0$ (330) and that yields the output f(n) force 332. The equivalent mathematical description of the flow diagram in the z-domain is shown in the equations (335, 340, and 350) of FIG. 3. Specifically equation 335 shows the discrete time representation of the flow diagram described above. Equation 340 shows Z-transformed version of equation 335, and equation 350 shows the resulting transfer function in the Z-domain that can be derived from 340.

Figure 4B:
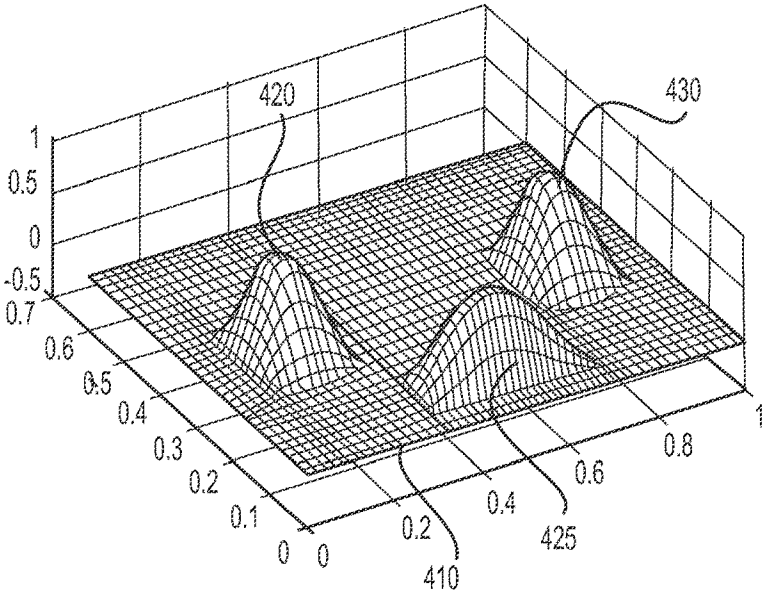
FIG. 4B shows the band-limited two-dimensional Fourier series reconstruction of the target shape function.
Figure 4A:
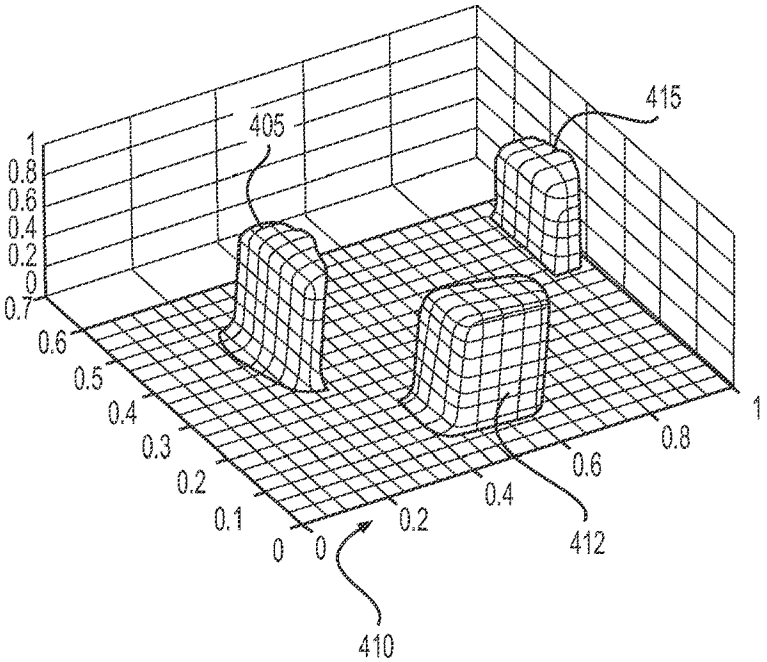
FIG. 4A shows an idealized target shape function for a plate panel.
Figures 5A, 5B:
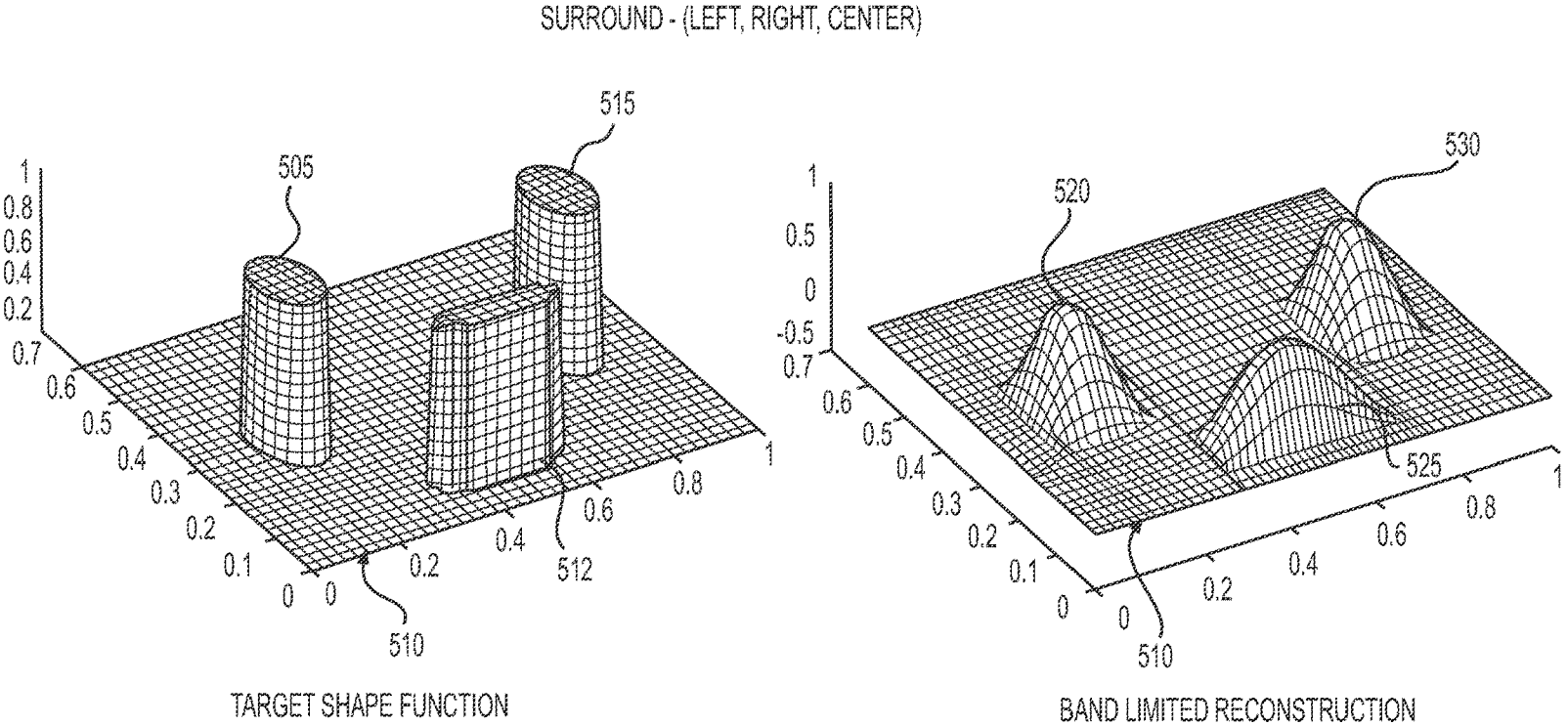
FIG. 5A shows an idealized target shape function for a plate panel.
FIG. 5B shows a band-limited reconstruction of the target shape function. In the case shown the reconstruction employs the lowest 64 modes.

FIGS. 4A and 4B each shows idealized target shape function for a panel on the left and the band-limited two-dimensional Fourier series reconstruction of the target shape function is shown on the right. Normal modes up to the (10,10) mode are included in the Fourier series reconstruction. The figure shows an example of a band-limited Fourier reconstruction of a target panel shape function. In the example shown, the target shape function shown in FIG. 10A on the left has the panel vibrations (and the resulting sound radiation) confined to left (405), right (415), and center regions (412) of the panel (410), such as for the front three channels of a surround sound system. A band-limited reconstruction (420, 425, and 430) of the specified spatial shape function is shown in FIG. 4B on the right. Only modes up to the tenth are included in the Fourier reconstruction.

Figure 6:
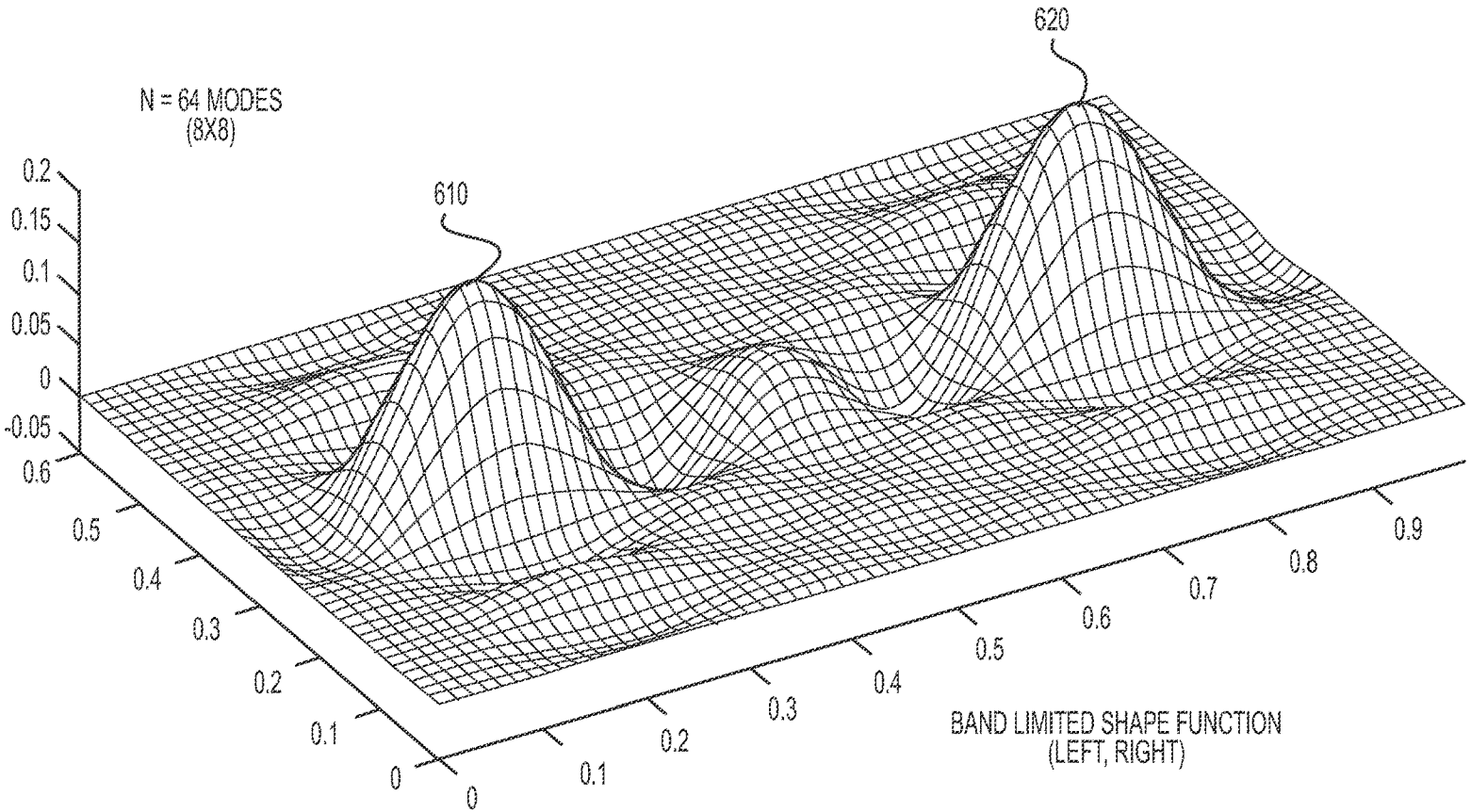
FIG. 6 illustrates a band-limited reconstruction (for the lowest 64 modes) for stereo sound reproduction.
Figure 7:
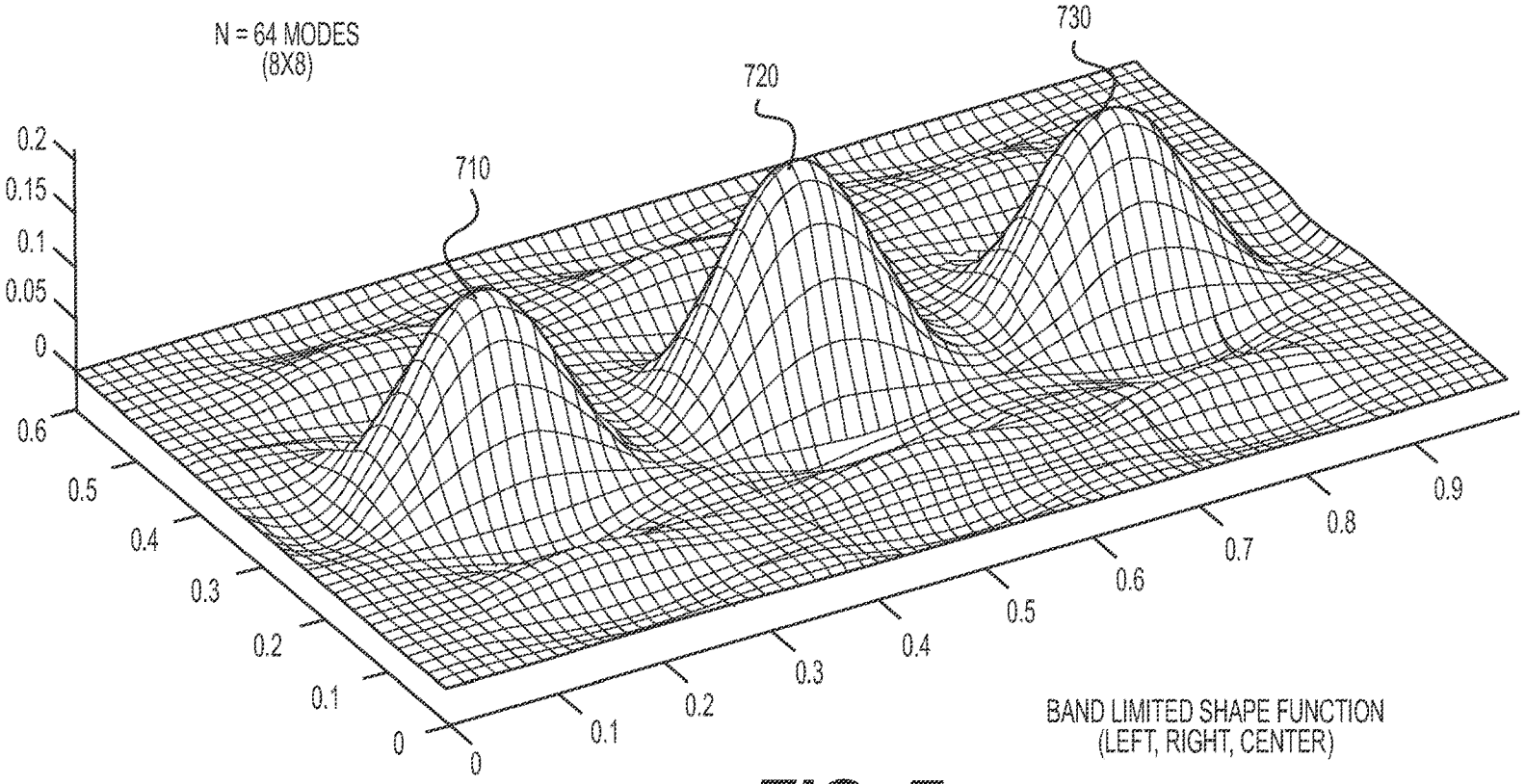
FIG. 7 illustrates a band-limited reconstruction (for the lowest 64 modes) for surround sound reproduction.
Figure 8:
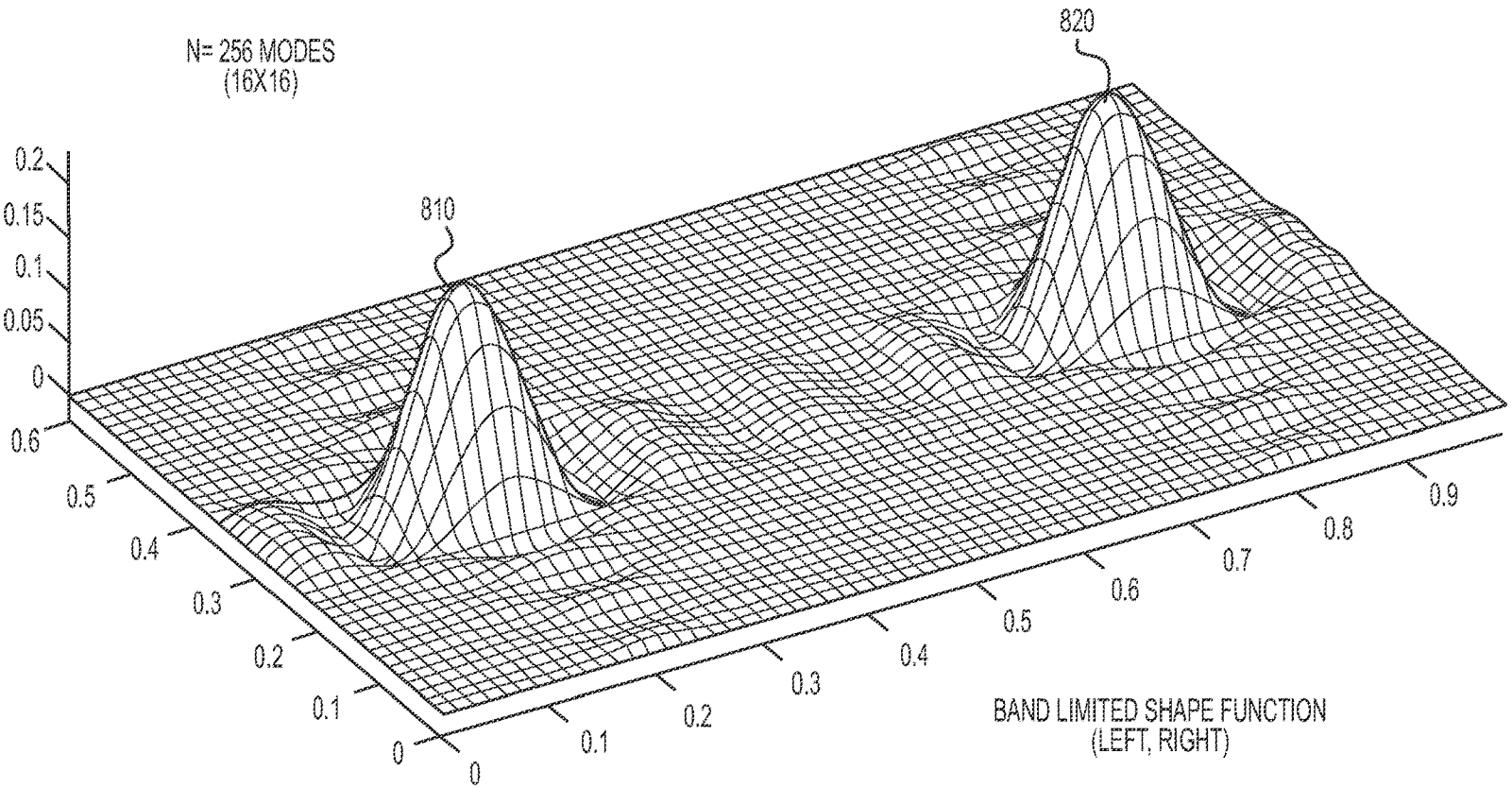
FIG. 8 illustrates a band-limited reconstruction (for the lowest 256 modes) for stereo sound reproduction.
Figure 9:
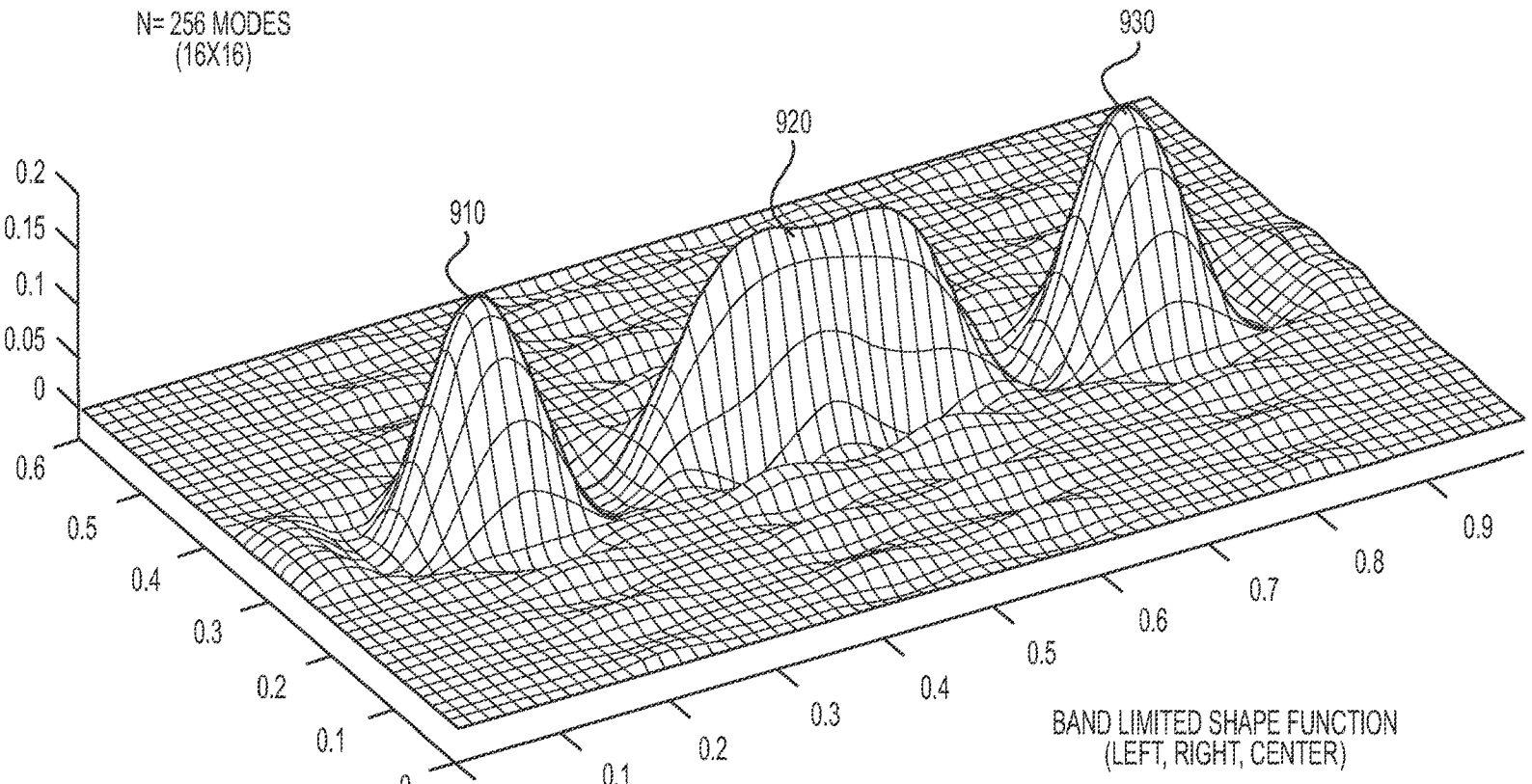
FIG. 9 illustrates a band-limited reconstruction (for the lowest 256 modes) for surround sound reproduction.

FIGS. 5-9 show various band-limited reconstruction of a target shape function. In FIG. 5A, the target vibration pattern has the panel vibrations confined to left (505), right (515), and center regions (512) of the panel (510); the band-limited reconstruction (520, 525, and 530) (in FIG. 5B) employs the lowest 64 modes. FIG. 6 illustrates a band-limited reconstruction (for the lowest 64 modes) for stereo sound reproduction. FIG. 6 shows the left (610) and right (620) channels. FIG. 7 illustrates a band-limited reconstruction (for the lowest 64 modes) for surround sound reproduction. FIG. 7 shows the left (710), right (730), and center (720) channels. FIG. 8 illustrates a band-limited reconstruction (for the lowest 256 modes) for stereo sound reproduction. FIG. 8 shows the left (810) and right (820) channels. FIG. 9 illustrates a band-limited reconstruction (for the lowest 256 modes) for surround sound reproduction. FIG. 9 shows the left (910), right (930), and center (920) channels.

Figure 10A:
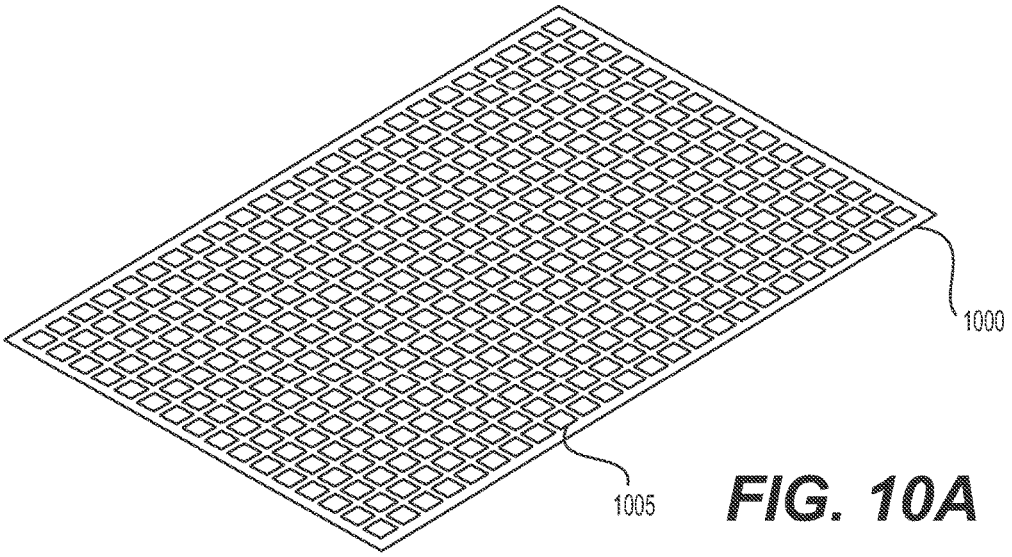
FIG. 10A shows the plurality of driver elements on a panel.

FIG. 10A shows the plurality of driver elements (a single driver element being represented as in 1005) on a panel 1000. The plurality of driver elements can comprise a regular two-dimensional rectangular array covering the plane of the panel with pre-determined center-to-center distances between driver element locations in the x and y directions. The panel can be any shape, for instance, rectangular as shown, or circular, triangular, polygon-shaped, or any other shape. The plurality of driver elements 1005 can be positioned on the panel 1000 in a predetermined arrangement. In one aspect, the predetermined arrangement can include a uniform grid-like pattern on the panel 1000, as shown.

Moreover, a portion of the plurality of driver elements 1005 can be transparent or substantially transparent to the visible part of the electromagnetic spectrum. Moreover, a portion of the driver elements can be fabricated using a transparent piezoelectric material such as PVDF or other transparent piezoelectric material. In various aspects, the driver elements comprising piezoelectric force actuators can be piezoelectric crystals, or stacks thereof. For example, they can be quartz or ceramics such as Lead Zirconate Titanate (PZT), piezoelectric polymers such as Polyvinylidene Fluoride (PVDF), and/or similar materials. The piezoelectric actuators may operate in both extensional and bending modes. They can furthermore feature transparent electrodes such as Indium Tin Oxide (ITO) or conductive nanoparticle-based inks. The driver elements may be bonded to a transparent panel such as glass, acrylic, or other such materials.

Figure 10B:
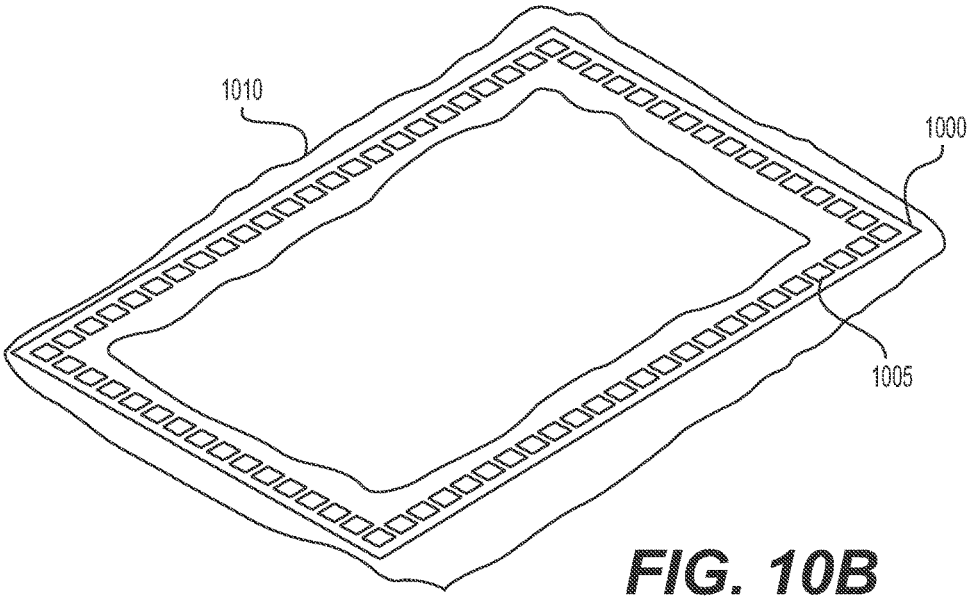
FIG. 10B shows that the driver elements can be arranged around the perimeter of the panel.

In another aspect, FIG. 10B shows that the driver elements 1005 can be arranged around the perimeter 1010 of the panel 1000. The driver elements around the perimeter of the panel 1010 may be uniformly spaced or positioned at Farey fraction locations, which will be discussed later.

A bezel (not shown) can moreover cover a portion of the perimeter of the panel 1010. In that regards, the driver elements 1005 can be positioned underneath the bezel associated with the perimeter of the panel 1010. Such driver elements 1005 positioned underneath the bezel can include a dynamic magnet driver element, a coil driver element, and the like. They, moreover, do not have to be transparent to the visible portion of the electromagnetic spectrum, since they are underneath the bezel.

In one aspect the piezoelectric material can be polarized so that an electric potential difference applied across the thickness of the material causes strain in the plane of the material. If the driver elements comprising the piezoelectric actuators are located away from the neutral axis of the composite structure, a bending force component perpendicular to the plate can be generated by the application of a voltage across the thickness of the actuator film. In another configuration piezoelectric force transducers may be mounted on both sides of the plate either in aligned pairs or in different array layouts.

Figure 11:
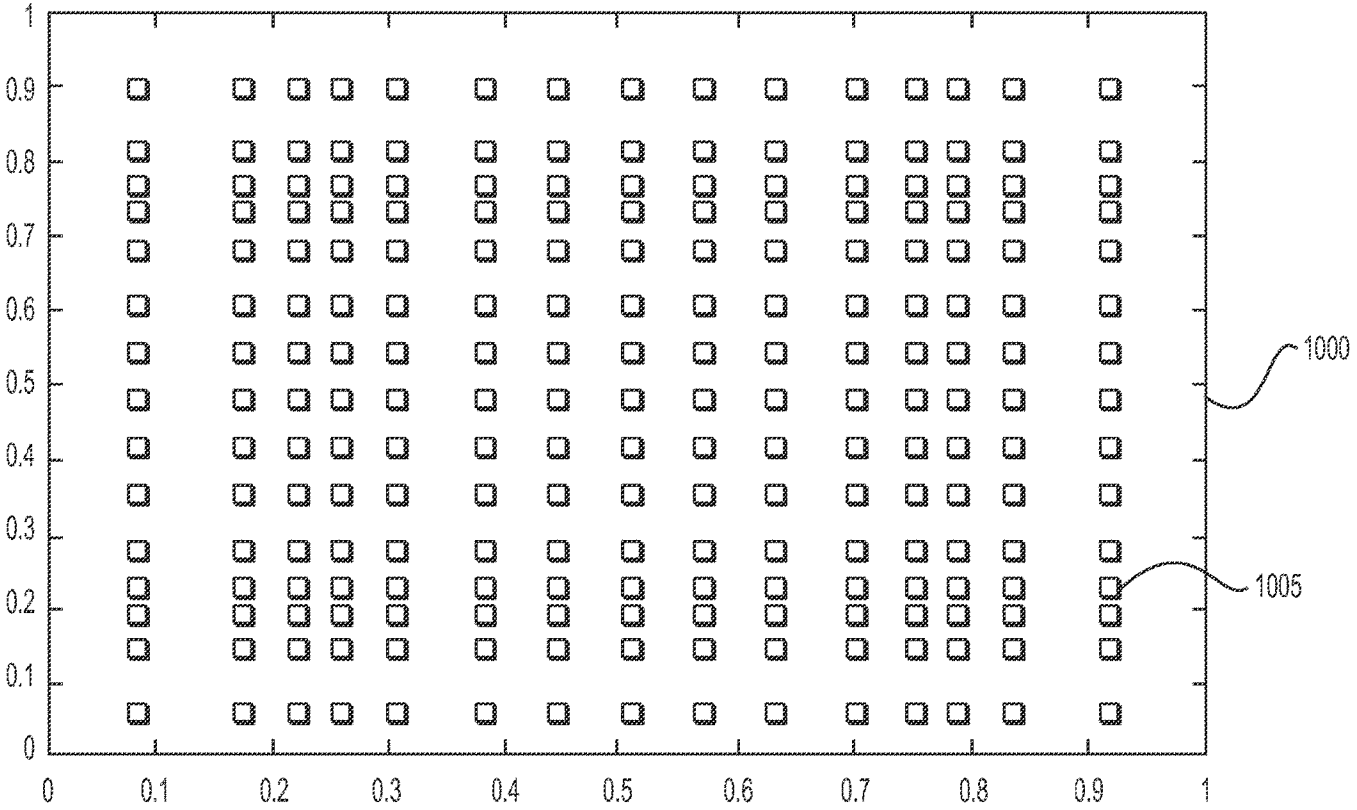
FIG. 11 shows the driver elements being positioned at pre-determined optimized locations on the panel for driving a selected set of pre-determined acoustic modes of the panel.

As shown in FIG. 11, the driver elements (a single driver element being represented as in 1005) can be positioned at pre-determined optimized locations on the panel 1000 for driving a pre-determined acoustic mode of the panel 1000. The predetermined optimized locations on the panel for driving a pre-determined acoustic mode of the panel can include a mathematically determined peak of the predetermined acoustic mode. For example, to drive the (1,1) mode of the panel 1000, the driver element 1005 at corresponding to row 05, and column 05 can be driven. While a single driver at any given location will excite several modes simultaneously—for example, using a driver in row 5—column 5 will excite the (1,1) mode but it also will excite the (3,1), (3,3), (5,1) (3,5) and many other modes—it is to be recognized that collective action of several drivers in the array can be chosen to selectively excite a desired mode.

In another aspect, the plurality of driver elements can comprise an array in which the actuators are located at selected anti-nodes of the plate panel vibrational modes. In the case in which the panel is simply supported, the mode shapes are sinusoidal. The actuator locations can then be at the following fractional distances (taking the dimension of the plate to be unity): n/m where m=1, 2, 3, . . . , and n=1, . . . m−1; for example {(1/2), (1/3, 2/3), (1/4, 2/4, 3/4), (1/5, 2/5, 3/5, 4/5), . . . }. Ratios formed according this rule can be referred to as Farey fractions. Repeated fractions can be removed and any subset of the full sequence can be selected.

Figures 12A, 12B:
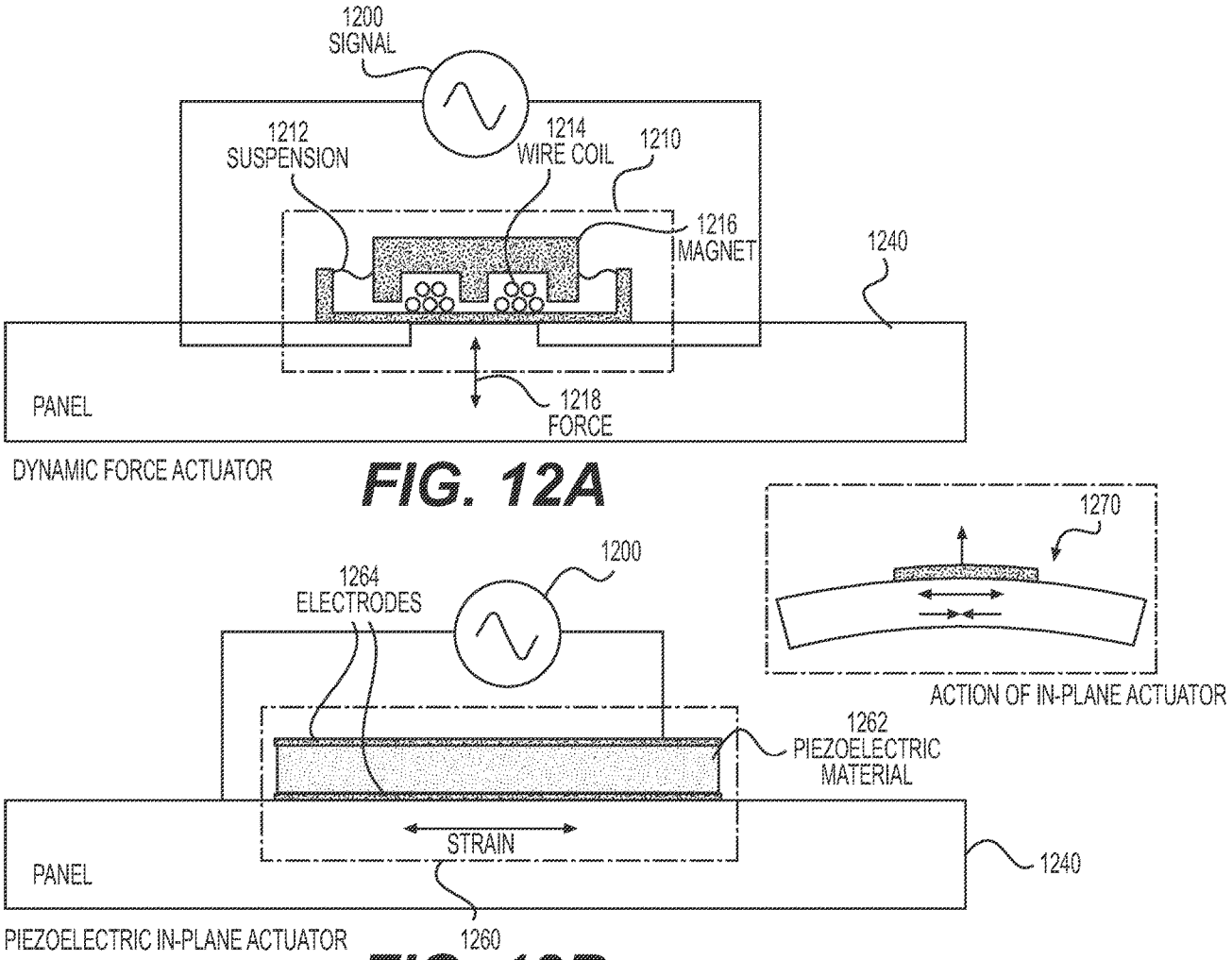
FIGS. 12A and 12B each shows example driver elements. Specifically.

FIGS. 12A and 12B each shows example driver elements. Specifically, FIG. 12A represents a dynamic force actuator. A current produced by a signal source 1200 passes through the dynamic force actuator's 1210 coil 1214 interacting with the magnetic field of a permanent magnet 1216, held by a suspension 1212. This can produce a force 1218 that is perpendicular to the plane of the panel 1240, thereby exciting panel bending vibrations.

FIG. 12B shows an example piezoelectric bending mode actuator 1260 bonded to one surface of a panel 1240. The piezoelectric material 1262 can be polarized so that a voltage 1200 applied by electrodes 1264 across the thin dimension of the element produces strain 1280 (and a force) in the plane of the actuator 1260 (see 1270). If the actuator 1260 is located off of the neutral axis of the composite structure it will exert a component of force perpendicular to the plane of the panel 1240, as shown in the inset (1270), thereby exciting panel bending vibrations.

Figure 13:
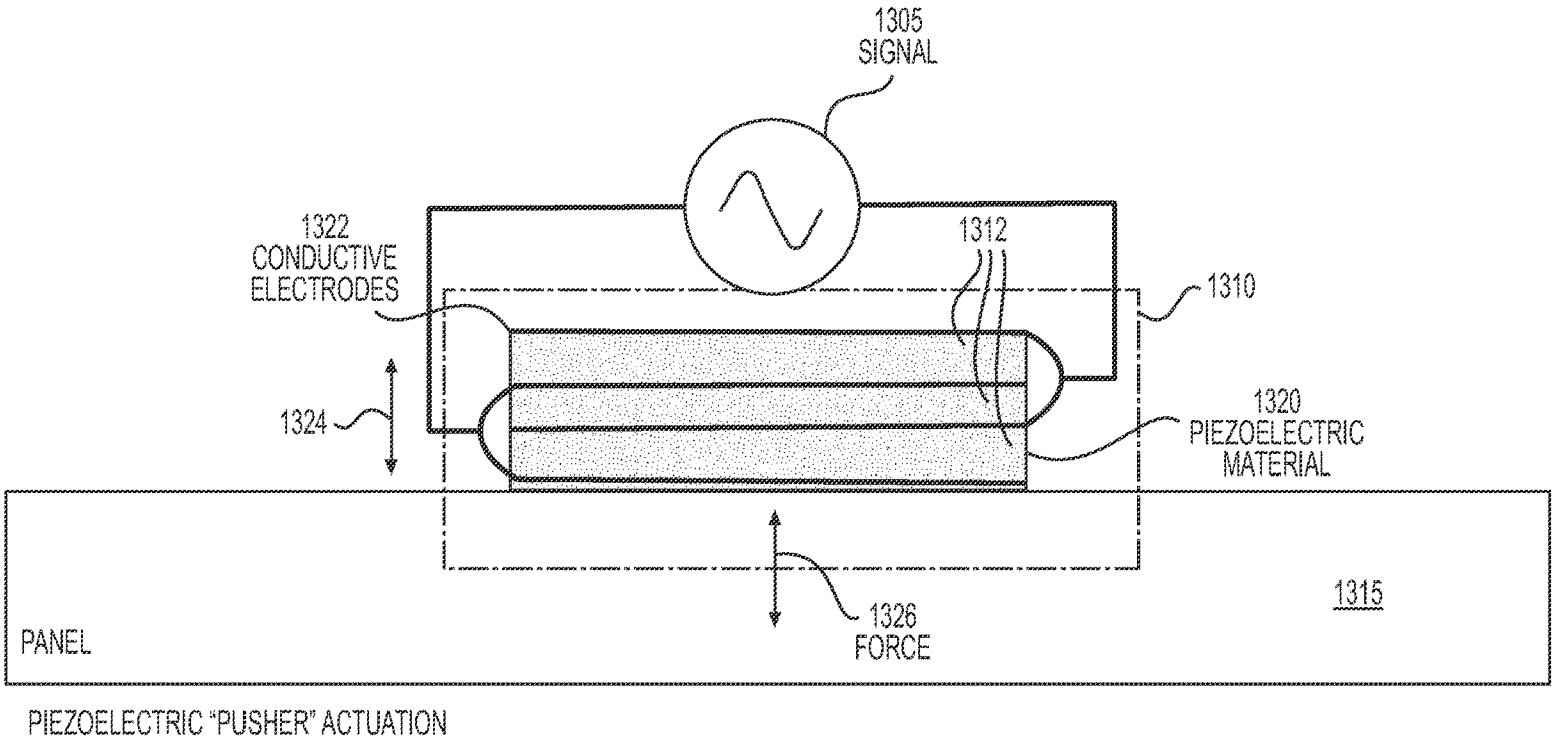
FIG. 13 shows a stacked piezoelectric pusher force actuator.

FIG. 13 shows a stacked piezoelectric pusher force actuator 1310. The stack of piezoelectric elements 1312 are polarized when a voltage 1305 is applied by conductive electrodes 1322 across the thin dimension 1324 of the element to cause a strain. A resulting force generated in the thin dimension 1324 of the elements can be employed to exert a force 1326 that is perpendicular to the plane of the panel 1315. The stack of elements 1312 is mechanically in series but electrically in parallel, thereby amplifying the amount of strain and force produced the actuator 1310.

Figure 14A:
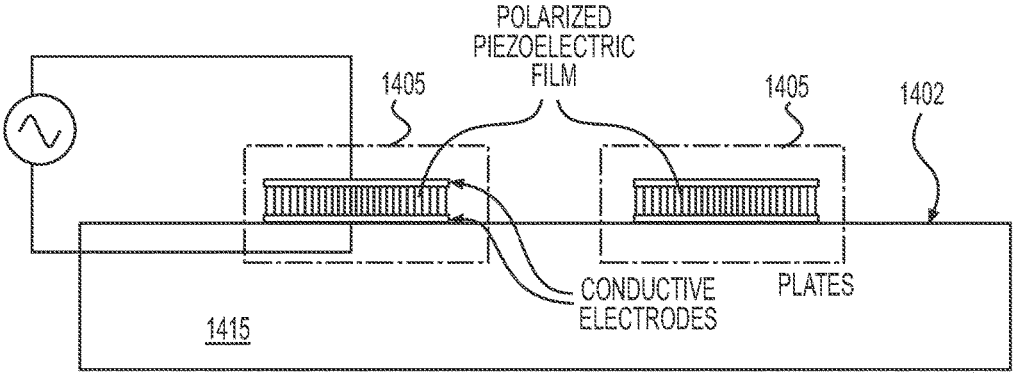
FIG. 14A shows an example array of individual piezoelectric actuators bonded to the surface of a plate.
Figure 14B:
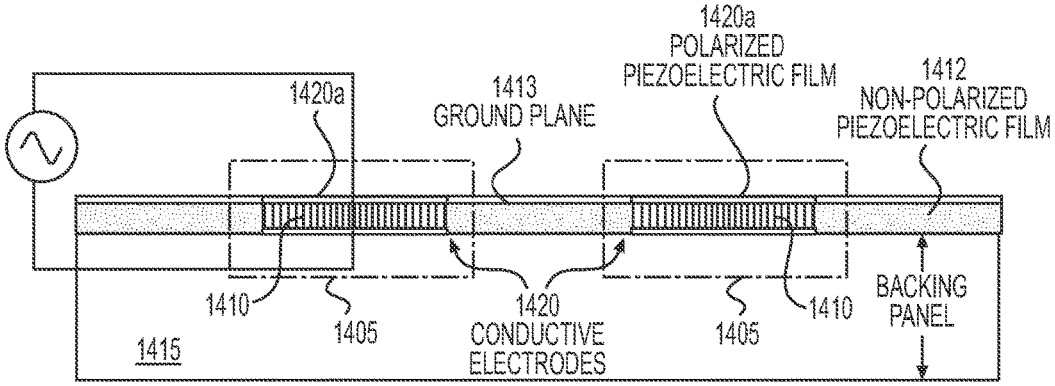
FIG. 14B shows an example configuration for an array of piezoelectric force actuators bonded to a plate.

FIG. 14A shows an array of individual piezoelectric actuators 1405 bonded to the surface 1402 of a plate 1415. FIG. 14B shows a configuration for an array of piezoelectric force actuators 1405 bonded to a plate 1415. In some embodiments, an array of electrodes (e.g., 1420) is formed on the surface of a plate 1415. The sheet of piezoelectric material (e.g., 1412) is then formed on the plate 1415 (e.g., over the electrodes 1420) and a top electrode (shown as 1420*a*) is then deposited to the outer surface of the film 1412. The piezoelectric material (e.g., 1412) is then "poled" (see 1410) to make regions of the film where the electrodes are located piezoelectrically active. The remaining sections of film are left in place (e.g., 1412).

In other embodiments, the array of electrodes (e.g., 1420) is formed on one side of a sheet of non-polarized piezoelectric material (e.g., 1412) prior to it being bonded to the plate 1415. The top electrode (shown as 1420*a*) is then deposited to the outer surface of the film 1412. The piezoelectric material (e.g., 1412) is then "poled" (see 1410) to make regions of the film where the electrodes are located piezoelectrically active, and the sheet of piezoelectric material (e.g., 1412) is then bonded on the plate 1415.

In yet other embodiments, the electrodes (e.g., 1420*a* and 1420) are formed on both side of the sheet of non-polarized piezoelectric material (e.g., 1412) prior to it being bonded to the plate 1415. The piezoelectric material (e.g., 1412) is then "poled" (see 1410) to make regions of the film where the electrodes are located piezoelectrically active, and the sheet of partially-polarized piezoelectric material (e.g., 1412) is then bonded on the plate 1415.

Figure 14C:
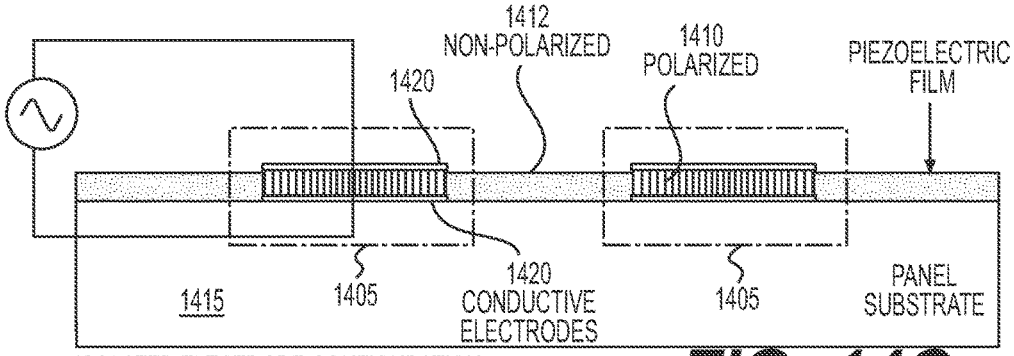
FIG. 14C shows an example configuration of piezoelectric actuators similar to that in FIG. 14*b* but for which each element has its own separate pair of electrodes.

FIG. 14C shows a configuration of piezoelectric actuators 1405 similar to that in FIG. 14B but for which each element has its own separate pair of electrodes 1420, i.e., the elements do not share a common ground plane (see FIG. 14B, 1413). This isolated electrode configuration allows greater flexibility in the application of voltages to individual elements.

In various aspects, the driver elements comprising piezoelectric force actuators can be piezoelectric crystals, or stacks thereof. For example, they can include quartz, ceramics such as Lead Zirconate Titanate (PZT), lanthanum doped PZT (PLZT), piezoelectric polymers such as Polyvinylidene Fluoride (PVDF), or similar materials. The piezoelectric force actuators may operate in both extensional and bending modes.

Figure 15:
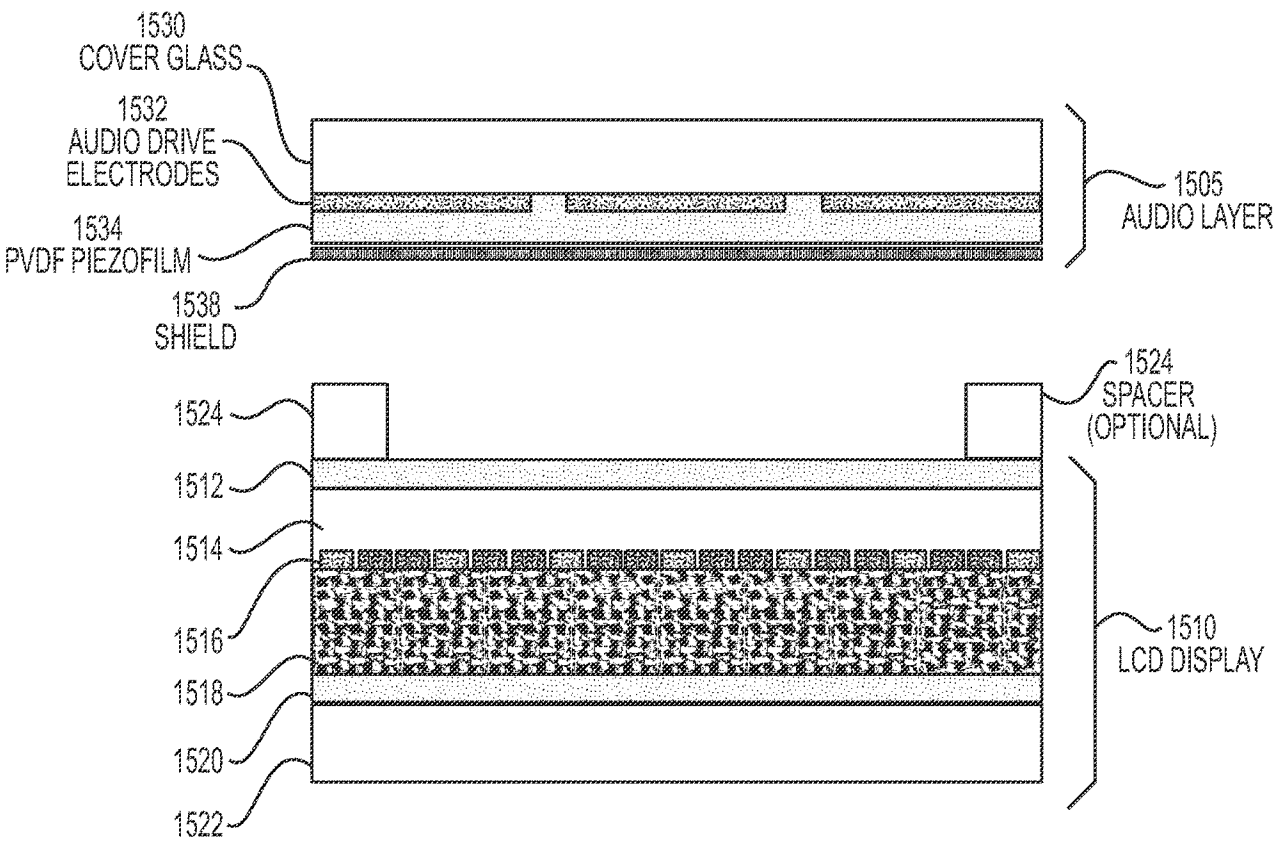
FIG. 15 shows an example integration of an audio layer with a liquid crystal display (LCD).

FIG. 15 shows the integration of an audio layer 1505 with an LCD display 1510. In this configuration a cover glass layer 1530 can serve as the outermost surface of the audio layer 1505. The cover glass 1530 can provide protection to the audio layer 1505 against detrimental environmental factors such as moisture. A piezoelectric film 1534 (such as polyvinylidene fluoride, PVDF, or other transparent material) can be bonded to the inside of the glass layer 1530. Drive electrodes 1532 can be deposited on both sides of the piezoelectric film 1534. The assembly can be positioned atop an LCD display or other type of display 1510. Spacers 1524 may be employed to provide a stand-off distance between the audio layer and the display. This can allow the vibrations of the audio layer 1505 as it produces sound to not vibrate the display 1510.

The LCD display 1510 can include some or all of the following layers: a protective cover 1512 of glass or a polymer material, a polarizer 1514, a color filter array 1516, liquid crystal 1518, thin-film transistor backplane 1520, and back-light plane 1522. Optional spacers, 1524, may be used to support the audio layer on top of the LCD display layer.

In an aspect, the display 1510 can comprise a light-emitting diode (LED), organic light emitting diode (OLED), and/or a plasma display. In another aspect, the audio layer can be laminated onto the LCD display using standard lamination techniques that are compatible with the temperature and operational parameters of the audio layer 1505 and display 1510. The layers of the audio layer can be deposited by standard techniques such as thermal evaporation, physical vapor deposition, epitaxy, and the like. The audio layer 1505 can alternatively be positioned below the display 1510. The audio layer 1505 can moreover be positioned over a portion of the display 1510, for example, around the perimeter of the display 1510.

In various aspects, the audio layer 1505 can moreover be overlain on a display such as a smart phone, tablet computer, computer monitor, or a large screen display, so that the view of the display is substantially unobstructed.

Figure 16:
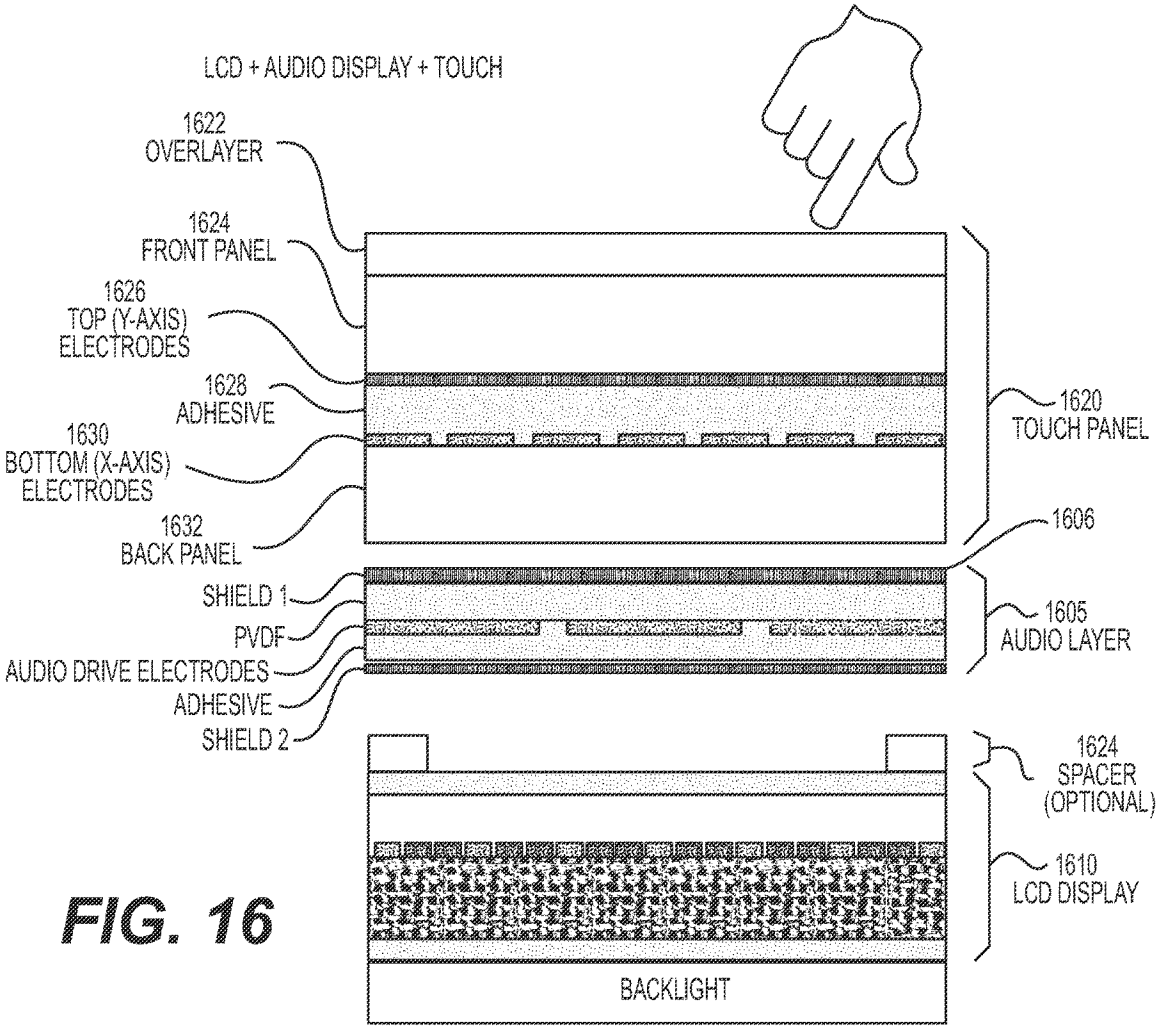
FIG. 16 shows an example audio layer integrated into a touch interface enabled display that comprises a display and a touch panel.

FIG. 16 shows an audio layer 1605 (e.g., as discussed in relation to audio layer 1505 in FIG. 15) integrated into a touch interface enabled display that comprises a display 1610 and a touch panel 1620. The audio layer can be sandwiched between the display 1610 (e.g., as discussed in relation to display 1510 in FIG. 15) and the touch panel 1620. Spacers (e.g., similar to 1624) can be positioned between the audio layer and the display layer, and/or between the audio layer and the touch panel (not shown). Also note that a backing surface (alternatively called a back panel) 1632 is not required in the audio layer 1605 with the bottom layer of the touch panel (1632) serving that purpose. Also note that a second ground plane 1606 can be included in the audio layer 1605 to shield the touch panel 1620 capacitive electrodes (1626 and 1630) from the high voltages employed in the force actuator in the audio layer 1605.

The touch panel can include an over layer 1622 that provides protection against detrimental environmental factors such as moisture. It can further include a front panel 1524 that contributes to the structural integrity for the touch panel. The touch panel can include top and bottom electrodes (in a 2-dimensional array) 1626 and 1630 separated by an adhesive layer 1628. As mentioned, a backing surface (alternatively called a back panel) 1632 can offer further structural rigidity.

In one aspect, the relative positioning of the audio layer 1605, touch panel 1620, and/or the display 1610 can be adjusted (for example, the audio layer 1605 may be positioned below the display 1610) based on preference and/or other manufacturing restrictions.

Figure 17B:
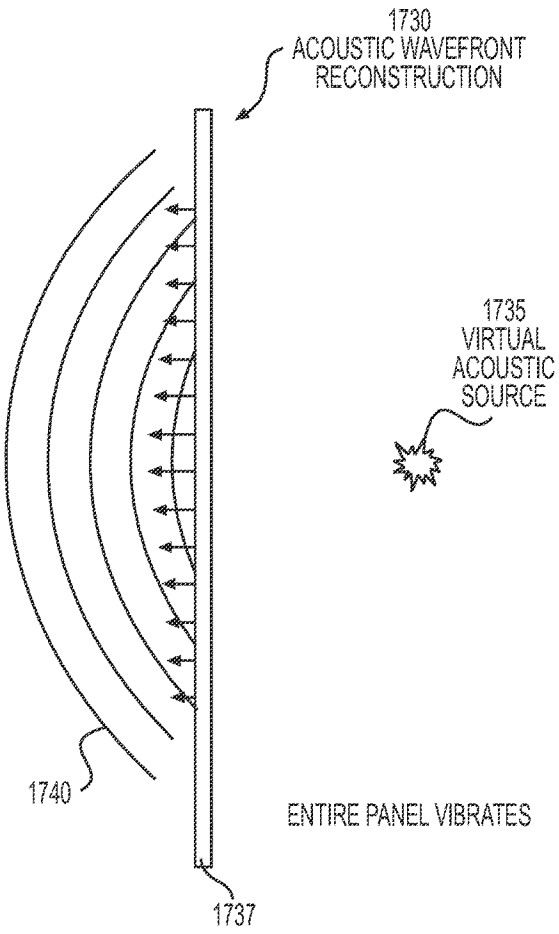
FIG. 17B shows the synthesis of a virtual acoustic source employing wave front reconstruction.
Figure 17A:
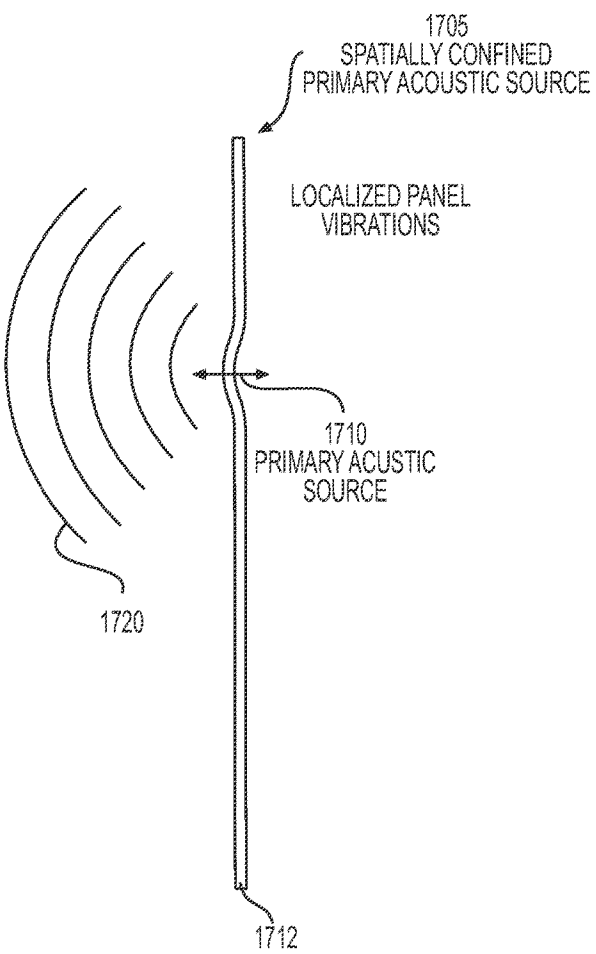
FIG. 17A shows the synthesis of a primary acoustic source by making the panel vibrate in a localized region to radiate sound waves.

FIG. 17A shows the synthesis of a primary acoustic source 1710 by making the panel 1712 vibrate in a localized region to radiate sound waves 1720. In this case, the localized region that is vibrated corresponds to the primary acoustic source 1710. FIG. 17B shows the synthesis of a virtual acoustic source 1735 employing wave-field synthesis source. In the latter case the entire surface of the panel 1737 is driven to vibrate in such a way that it radiates sound waves 1740 distributed to create a virtual source 1735 located at some point behind the plane of the panel 1737.

Figure 18C:
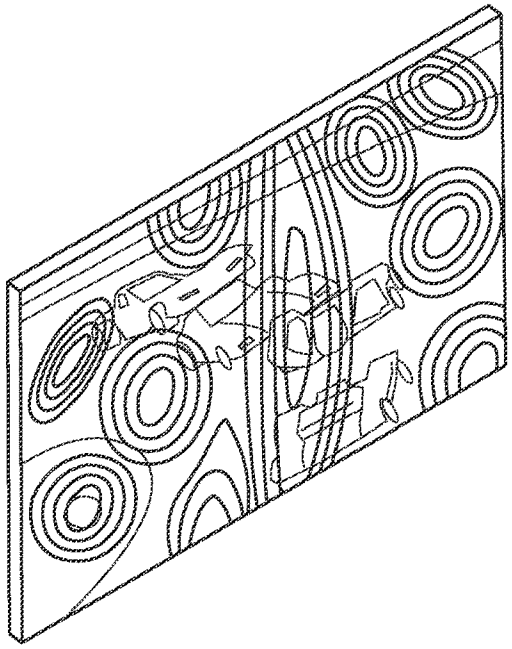
FIGS. 18A, 18B, and 18C show two possible applications of primary acoustic source control. Specifically.
Figure 18B:
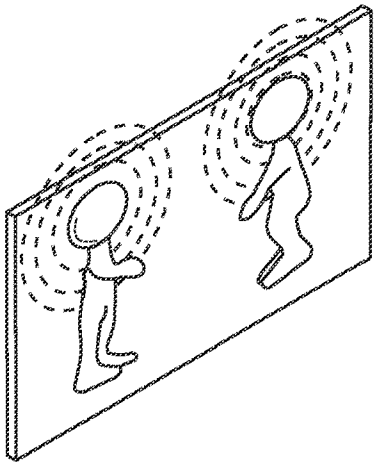
Figure 18A:
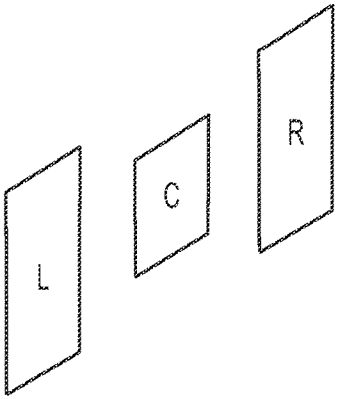

FIG. 18, comprising FIGS. 18A, 18B, and 18C, shows two possible applications of primary acoustic source control. FIG. 18A shows the panel vibrations being controlled to produce the left, right and center channels in a for a surround sound application. FIG. 18B shows the audio sources being bound to a portion of a video or image associated with a display. For example speech audio signals may be bound in this way to the video and/or images of one or more speakers being shown. FIG. 18C shows how the composite wavefronts at the plane of the display from an array of secondary audio sources would be synthesized by the audio display using wave field synthesis to simulate a virtual acoustic source.

Figure 19:
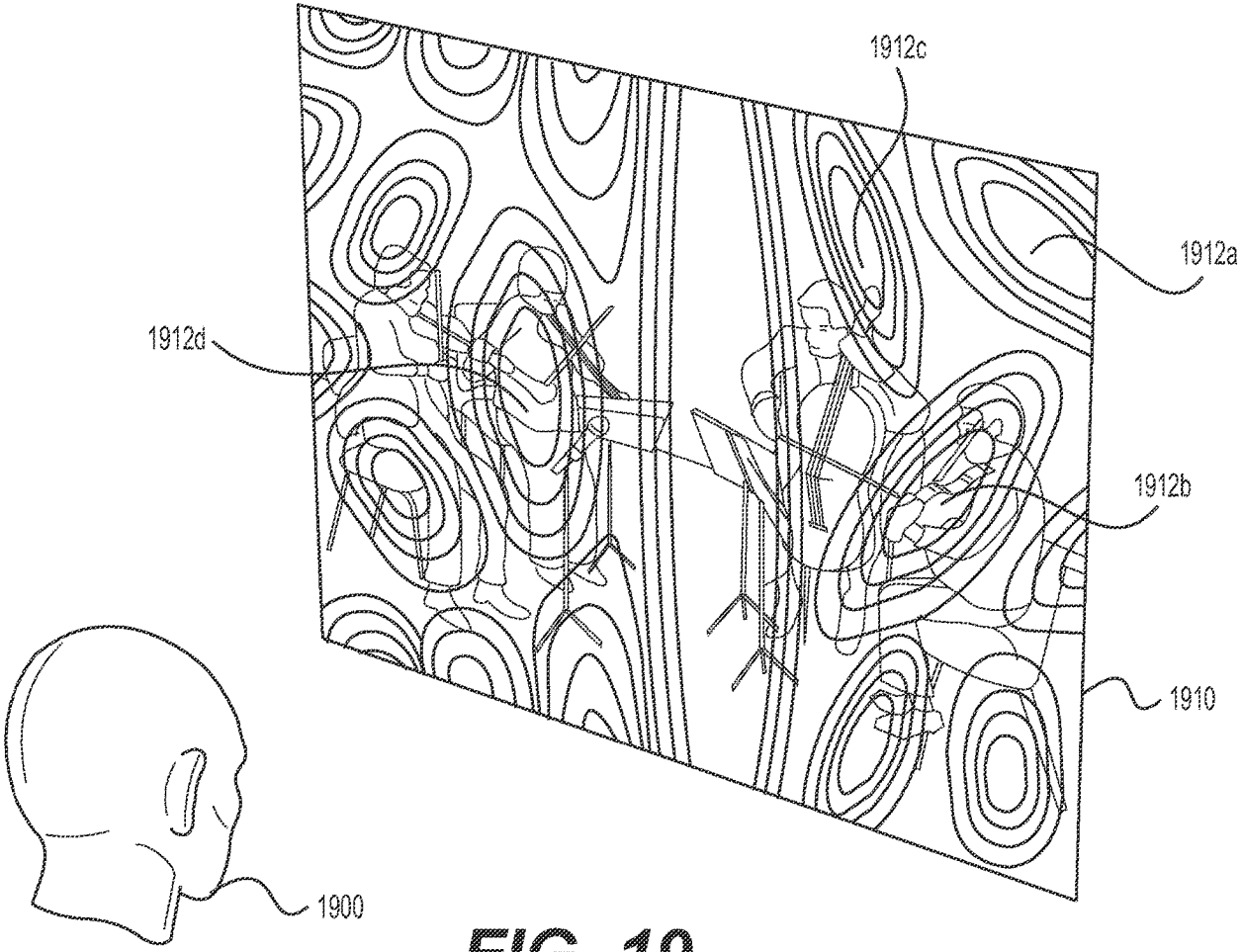
FIG. 19 illustrates wavefront reconstruction in which the combined acoustic wave fronts of multiple acoustic sources are produced at the plane of the audio display.

FIG. 19 illustrates wavefront reconstruction in which the combined acoustic wave fronts of multiple acoustic sources (e.g., 1912*a*, 1912*b*, 1912*c*, 1912*d*, etc.) are produced at the plane of the audio display, 1910, with respect to a viewer 1900. In some embodiments, portions of the generated acoustic sources coincides (i.e., dynamically moves) with the displayed imagery and other portions of the generated acoustic source are fixed with respect with the viewed imagery.

Example—Audio Display for Video Projection System

Figure 20:
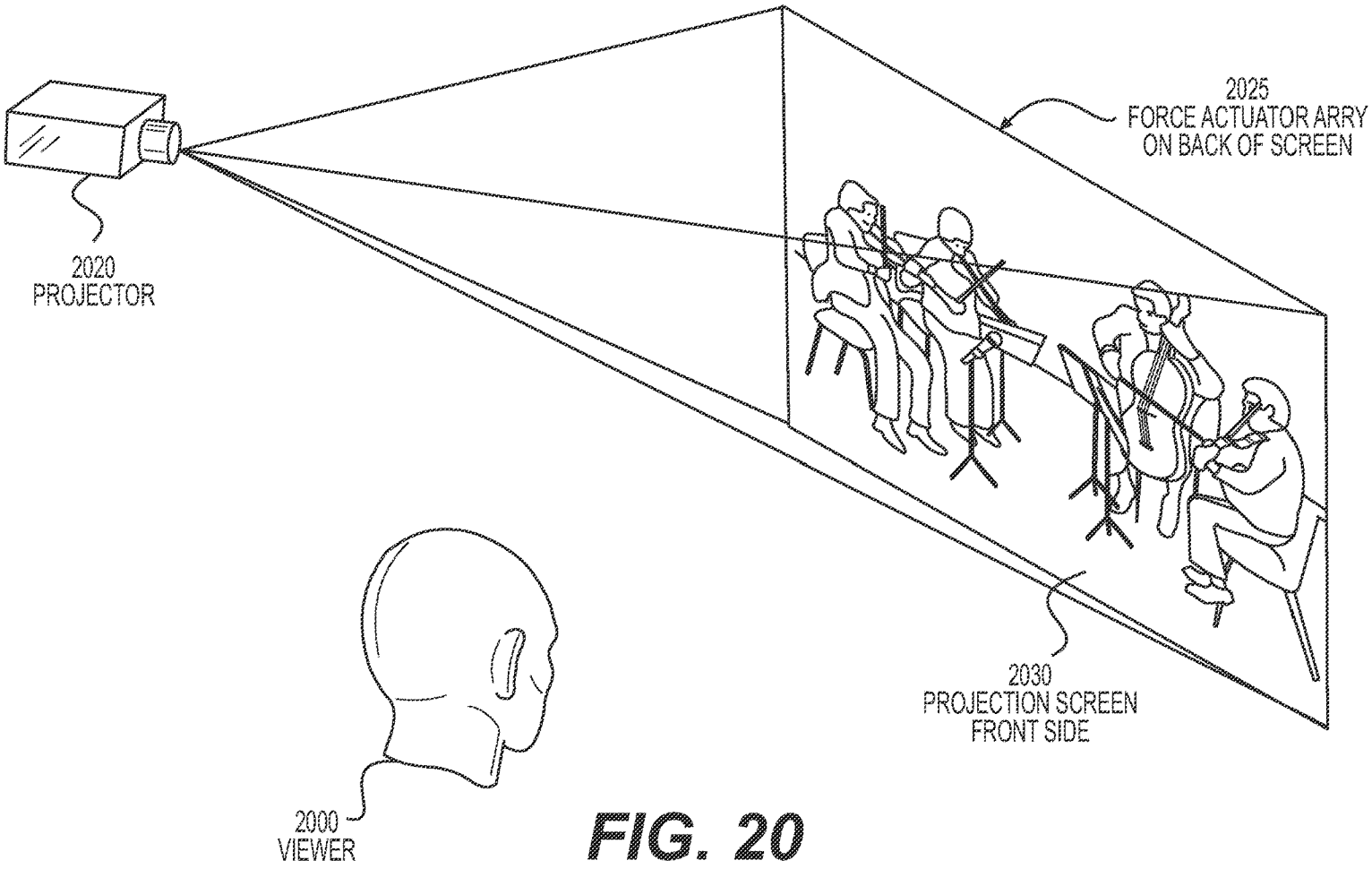
FIG. 20 shows an implementation of an example audio display for a video projection system. An array of force actuators are attached to the back of the reflective screen onto which images are projected.

FIG. 20 shows an implementation of an audio display for a video projection system with respect to a viewer 2000. An array of force actuators 2025 are attached to the back of the reflective screen 2030 onto which images are projected via a projector 2020.

Figure 21:
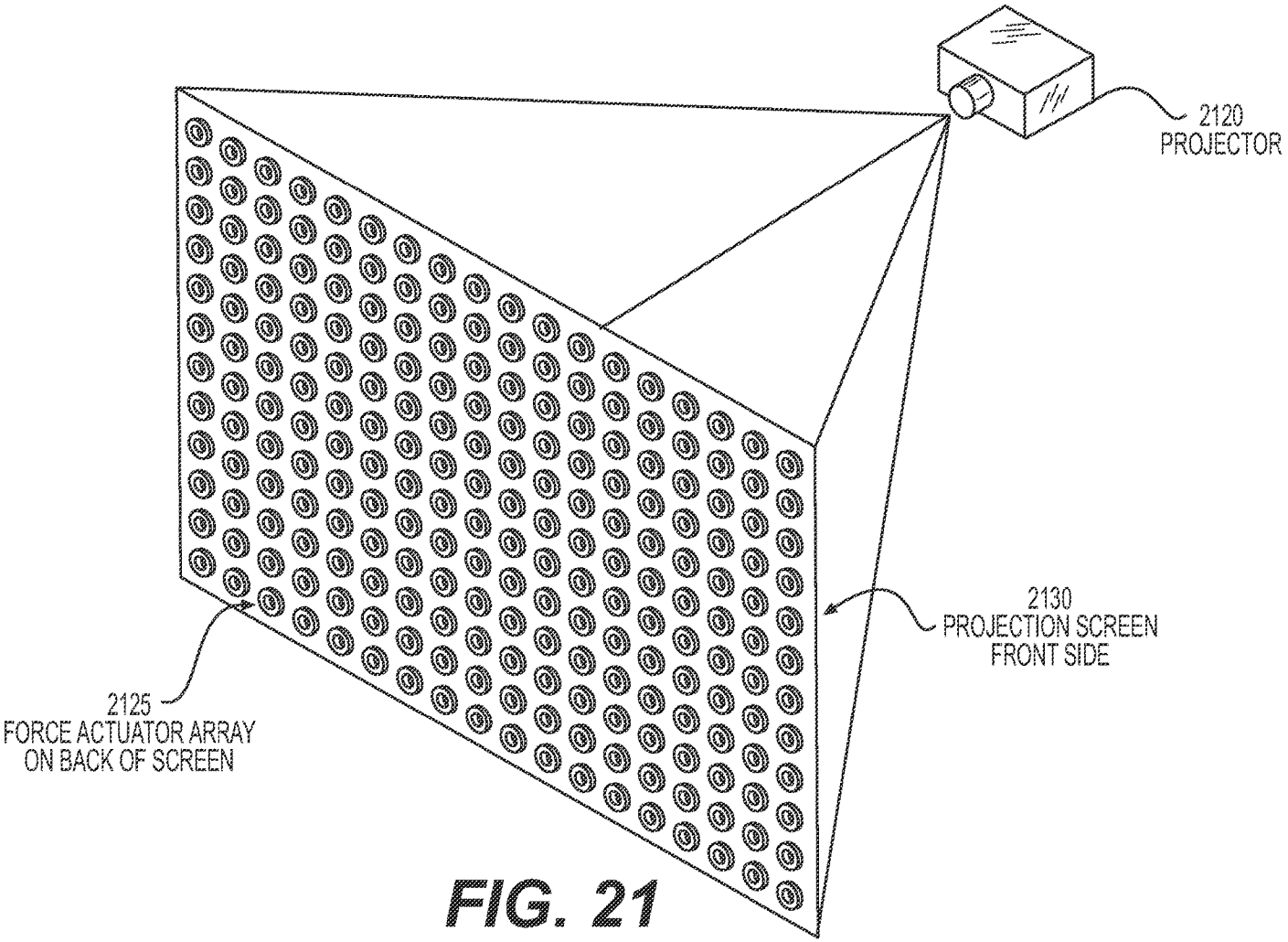
FIG. 21 is a view of an example projection audio display from the back side showing the array of force actuators.

FIG. 21 is a view of a projection audio display from the back side showing the array of force actuators 2125, the front side of the projection screen 2130, and the projector 2120.

Example—Phase Array Sound Synthesis

Figure 22:
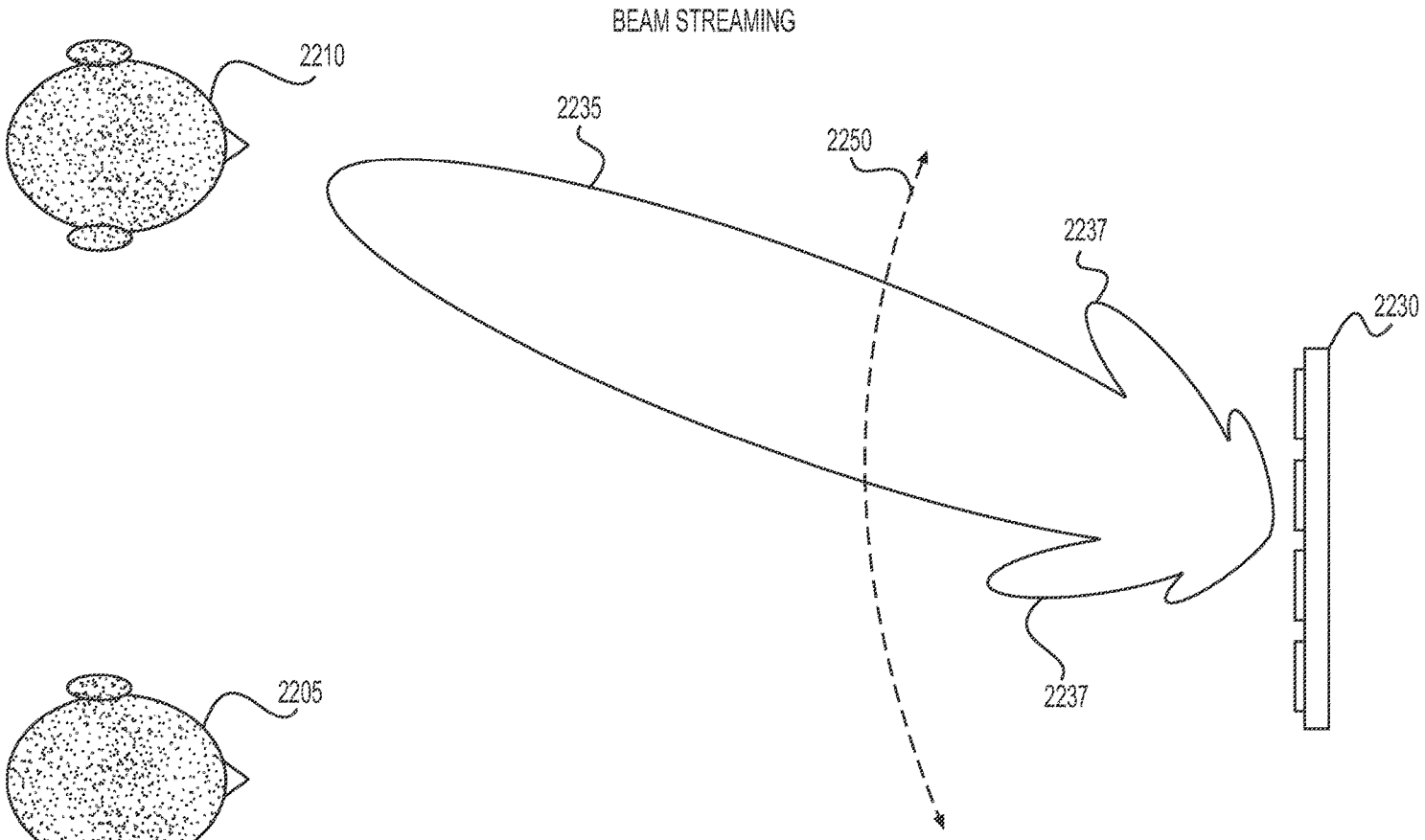
FIG. 22 is an illustration of beam steering in a phased array sound synthesis scheme.

FIG. 22 is an illustration of beam steering in a phased array sound synthesis scheme. Here, the display including the driver elements 2230 can project a beam of audio, including a main lobe 2235 directed to a given viewer/listener (2210 or 2205). The beam can furthermore be steered (i.e. re-oriented) as represented by 2250. This can be achieved through phased array methods, for example. A series of side lobes 2237 can exist in addition to the main lobe 2235, but can have a reduced amplitude with respect to the main lobe 2235. In this manner, an audio signal can be beamed such that if a receiver is positioned within a predetermined angular range with respect to a vector defining a normal direction to the plane of the panel defined at a predetermined location on the display, the receiver can receive an audio signal having a higher amplitude than a receiver positioned outside the predetermined angular range. Moreover, one or more cameras can be used to track the location of the viewers/listeners (2210 and 2205), and the locations are used by the beam steering technique to direct the audio signal to the viewers/listeners (2210 and 2205).

Figure 23:
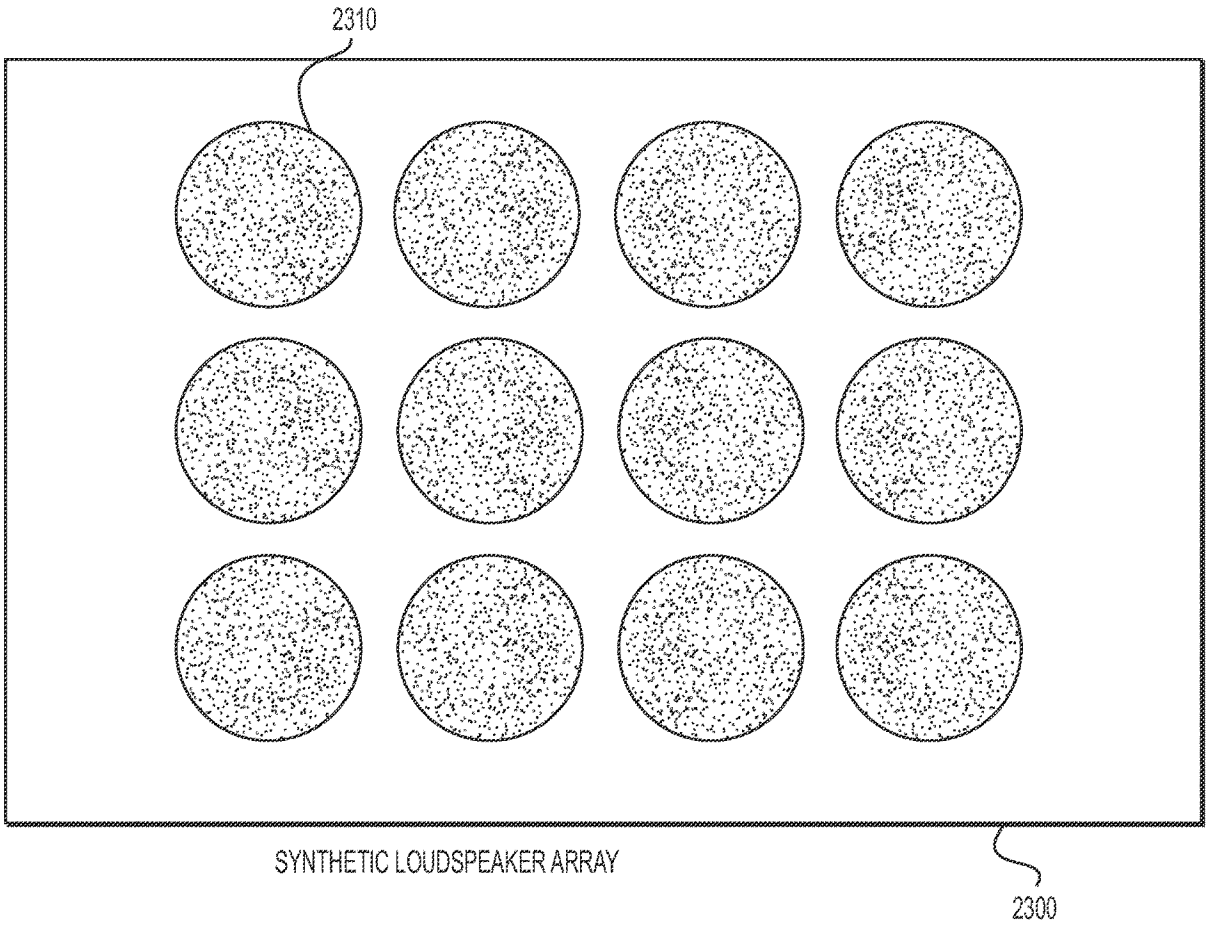
FIG. 23 shows a rectangular array of primary sound sources in the plane of the audio display. Phased array techniques may be employed to direct the acoustic radiation in any selected direction.

FIG. 23 shows a rectangular array of primary sound sources 2310 in the plane of the audio display 2300. The primary sound sources 2310 can comprise many driver elements. Phased array techniques may be employed to direct the acoustic radiation in any selected direction.

Figure 24:
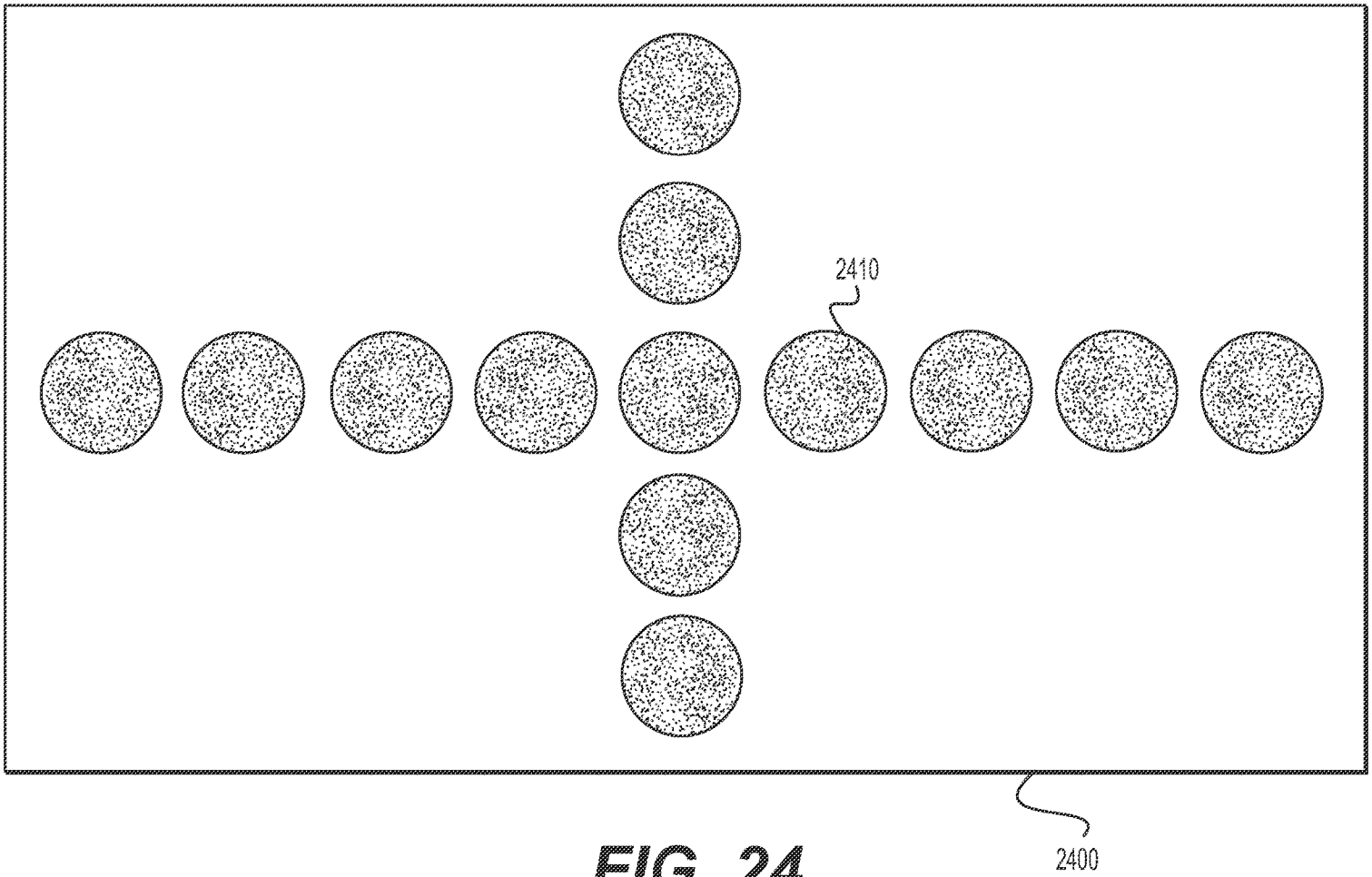
FIG. 24 shows a cross-shaped array of primary sound sources in the plane of the audio display, which can be employed in a phased array sound beaming scheme.

FIG. 24 shows a cross-shaped array of primary sound sources 2410 in the plane of the audio display 2400, which can be employed in a phased array sound beaming scheme. The primary sound sources 2410 can comprise many driver elements.

Figure 25:
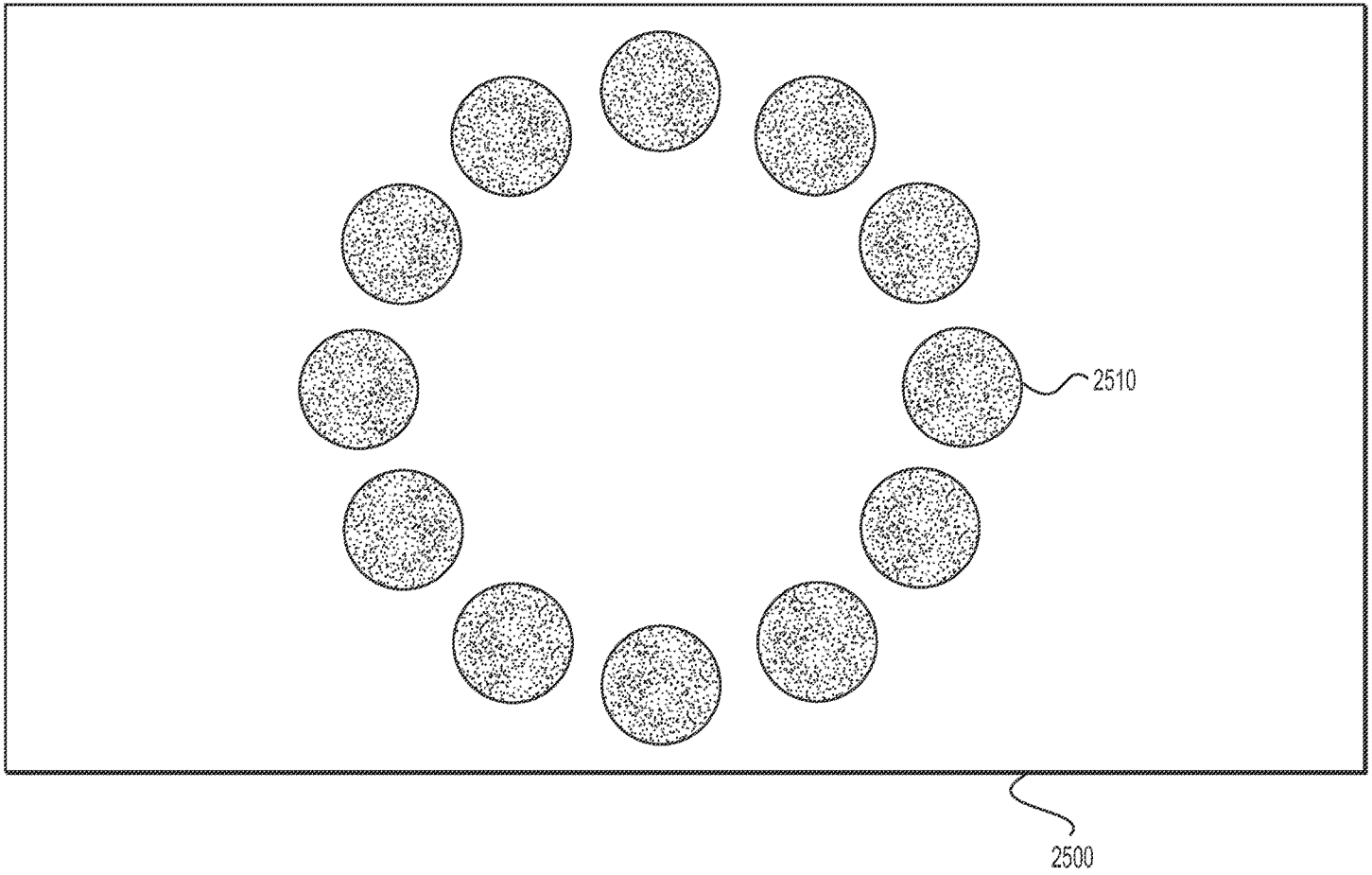
FIG. 25 shows a circular array of primary sound sources in the plane of the audio display with which a phased array sound beaming scheme may be employed.

FIG. 25 shows a circular array of primary sound sources 2510 in the plane of the audio display 2500 with which a phased array sound beaming scheme may be employed. The primary sound sources 2500 can comprise many driver elements.

Example—Audio OLED Display

The continued development of OLED display technology has led to monolithic displays that are very thin (as thin as 1 mm or less) and flexible. This has created the opportunity to employ the display itself as a flat-panel loudspeaker by exciting bending vibrations of the monolithic display via an array of force driving elements mounted to its back. The displays often are not flat, being curved, in some embodiments, to achieve a more immersive cinematic effect. The methods described here will work equally well in such implementations. Actuating the vibrations of a display from its back eliminates the need to develop a transparent overlayer structure to serve as the vibrating, sound emitting element in an audio display. As described above, such structures could be fabricated employing transparent piezoelectric bending actuators using materials such as PLZT (Lanthanum-doped lead zirconate titonate) on glass or PVDF (Polyvinylidene fluoride) on various transparent polymers.

Both voice-coil type actuators (magnet and coil) and piezo-electric actuators, as discussed in relation to FIGS. 12-14, may be mounted to the back of a flexible display to actuate vibrations.

Figure 26:
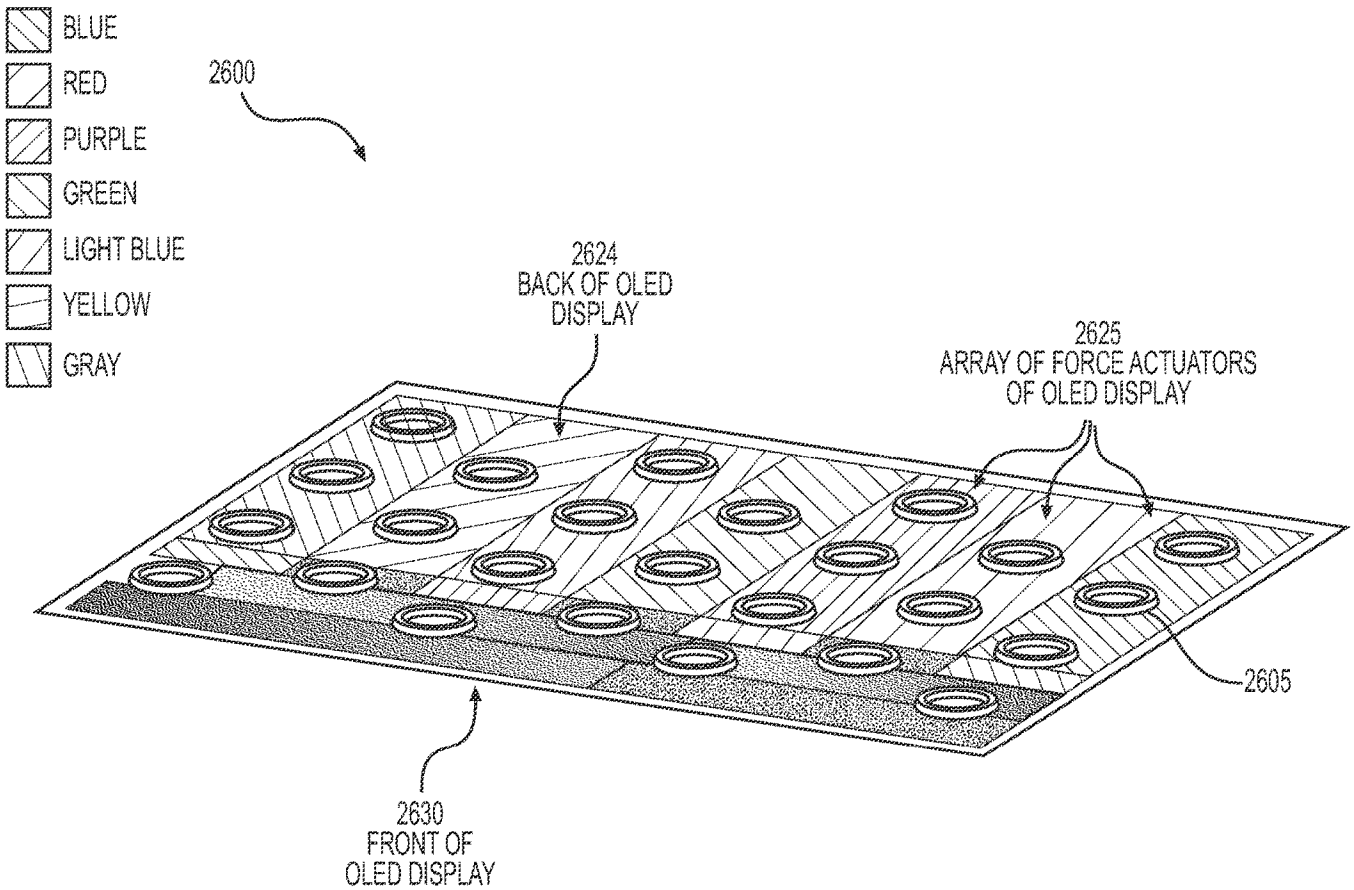
FIG. 26 illustrates an example OLED display with an array of voice-coil actuators attached to the back of the panel.

FIG. 26 illustrates an OLED display 2600 with an array of voice-coil actuators 2625 (e.g., one actuator is shown as 2605) attached to the back of the panel (2624). The number and locations of the actuators can be adjusted to achieve various design goals. A denser array of force actuators enables higher spatial resolution in the control of panel vibrations and the precise actuator locations can be chosen to optimize the electro-mechanical efficiency of the actuator array or various other performance metrics.

Figure 27:
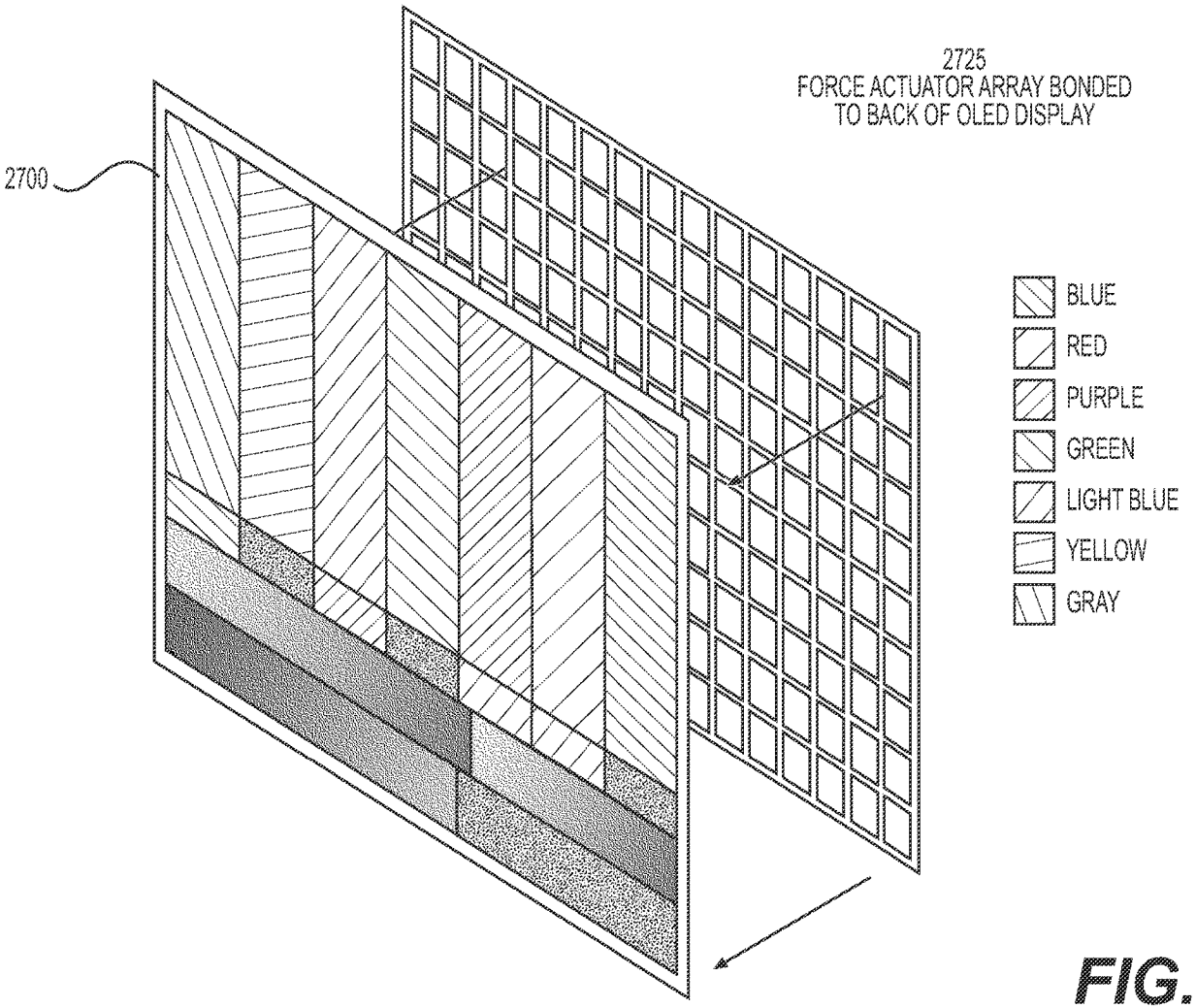
FIG. 27 shows an example array of piezoelectric force actuators mounted to the back of an OLED display.

FIG. 27 shows an array of piezoelectric force actuators 2725 mounted to the back of an OLED display 2700. The actuators would operate, in some embodiments, in their bending mode in which a voltage applied across the thin dimension of the piezoelectric material causes it to expand or contract in plane. As shown, the actuator array 2725 may be formed on a substrate that can be bonded to the back of the OLED display 2700. In some embodiments, an interposing layer is placed between the back of the OLED display 2700 and the formed substrate of the actuator array 2725. In some embodiments, it is important to match the Young's modulus of the piezoelectric material to the OLED backplane substrate material and/or the interposing layer. For example, for OLED's fabricated on a glass backplane, it may be advantageous to employ a glass, ceramic, or similar material as the force actuator substrate and employ a piezoelectric actuator material such as PZT (lead zirconate titanate) or similar "hard" piezoelectric material. For OLEDs with a backplane fabricated on polyimide or other "soft" polymer material, a soft piezoelectric material (with a low Young's modulus) such as the polymer PVDF (polyvinylidene fluoride), and the like, may be used. A piezo substrate material with a similar Young's modulus can also be employed.

Figure 28B:
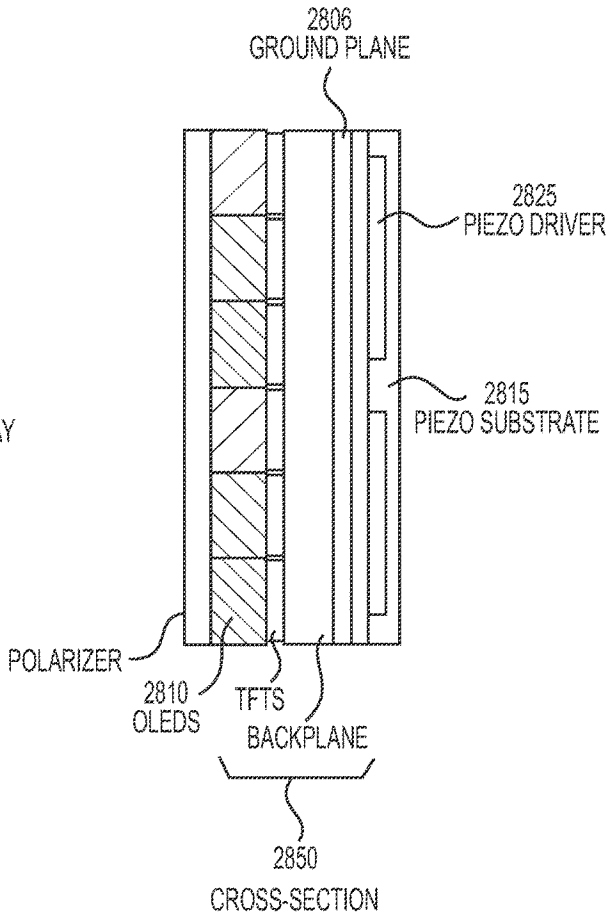
FIGS. 28A and 28B, shows an expanded view of an example monolithic OLED Display with piezo driver array.
Figure 28A:
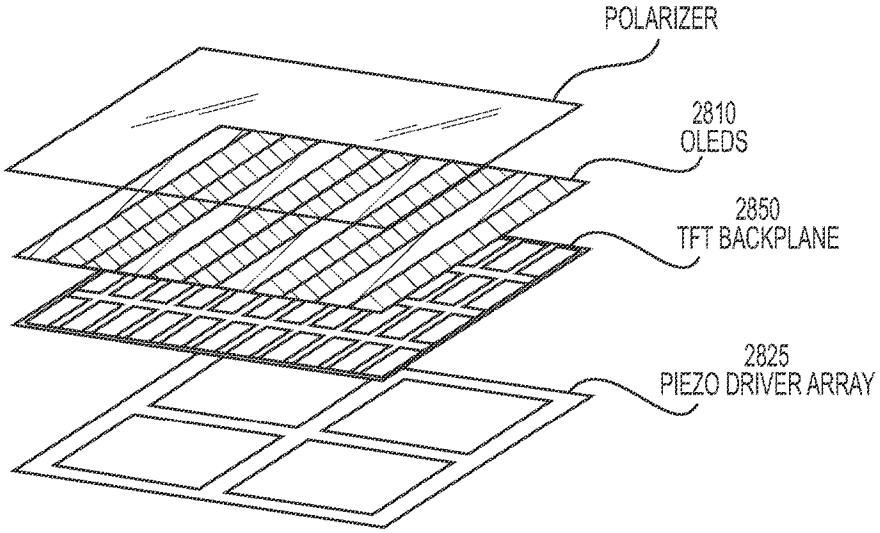

FIGS. 28A and 28B each shows an expanded view of a monolithic OLED Display with piezo driver array 2825 (e.g., as for example discussed in relation to array 2625 and 2725 in FIGS. 26 and 27). As shown in FIGS. 28A and 28B, the piezo-driver array 2825 in the form of a polymer sheet could be bonded to the back of the OLED display (shown comprising a TFT backplane 2850). In some embodiments, an interposing layer is placed between the back of the OLED display and the polymer sheet. FIG. 28B shows a cross section of the monolithic structure including the piezoelectric actuator patches 2825 fabricated on a substrate material 2815 with a ground plane 2806 on the actuator sheet 2825 to isolate the OLED thin film transistors 2810 from the electric fields required to energize the piezoelectric actuators (e.g., 2825).

CONCLUSION

While the methods and systems have been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

Throughout this application, various publications may be referenced. The disclosures of these publications in their entireties are hereby incorporated by reference into this application in order to more fully describe the state of the art to which the methods and systems pertain.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

What is claimed is:

1. A method of effecting spatial and temporal control of the vibrations of a panel, comprising:

receiving a shape function and an audio signal;

determining a band-limited Fourier series representation of the shape function;

computing one or more modal accelerations from the audio signal and the band-limited Fourier series representation of the shape function;

computing, using a frequency domain plate-bending mode response, one or more modal forces needed to produce the one or more modal accelerations;

determining a response associated with a discrete-time filter corresponding to the frequency domain plate bending mode response;

summing the one or more modal forces to determine a force required at each driver element in a plurality of driver elements;

performing a multichannel digital-to-analog conversion and amplification of one or more forces required at each driver element in the plurality of driver elements; and driving a plurality of amplifiers with the converted and amplified forces required at each driver element in the plurality of driver elements.

2. The method of claim 1, wherein a left channel, a center channel, and a right channel are excited by the plurality of driver elements to produce a surround sound or a stereo sound.

3. The method of claim 1, wherein the audio signal is spatially tied to one selected from the group consisting of a portion of an image associated with a display and a portion of a video associated with a display.

4. The method of claim 1, further comprising positioning the plurality of driver elements on the panel in a predetermined arrangement, wherein the predetermined arrangement comprises a uniform grid-like pattern on the panel, preferably wherein the predetermined arrangement comprises the driver elements being arranged around the perimeter of the panel.

5. The method of claim 1, wherein at least a portion of the plurality of driver elements are transparent to a visible part of the electromagnetic spectrum.

6. The method of claim 1, further comprising positioning the plurality of driver elements on the panel in a predetermined arrangement, wherein the predetermined arrangement comprises the driver elements being arranged around the perimeter of the panel.

7. The method of claim 6, wherein driver elements are positioned underneath a bezel associated with the perimeter of the panel.

8. The method of claim 7, wherein the driver elements comprise one or more of a dynamic magnet driver element and a coil driver element.

9. The method of claim 1, wherein the driver elements are positioned at a pre-determined location on the panel corresponding to determined peak of the predetermined acoustic mode.

10. The method of claim 1, wherein the audio signal is beamed, via a beam steering operation, such that if a receiver is positioned within a predetermined angular range with respect to a vector defining a normal direction to the plane of the panel defined at a predetermined location on the display, the receiver receives the audio signal with a higher amplitude than when the receiver is positioned outside the predetermined angular range.

11. A system for spatial and temporal control of the vibrations of a panel, comprising:

a functional portion of a display;

an audio layer comprising a plate and a plurality of driver elements, wherein the functional portion of the display is proximate to the audio layer, wherein the plurality of driver elements comprise a plurality of amplifiers; and a processor and a memory having instructions stored thereon, wherein execution of the instructions by the processor causes the processor to:

receive a shape function and an audio signal;

determine a band-limited Fourier series representation of the shape function;

compute one or more modal accelerations from the audio signal and the band-limited Fourier series representation of the shape function;

compute, using a frequency domain plate-bending mode response, one or more modal forces needed to produce the one or more modal accelerations;

determine a response associated with a discrete-time filter corresponding to the frequency domain plate bending mode response;

sum the one or more modal forces to determine a force required at each driver element in a plurality of driver elements;

perform a multichannel digital-to-analog conversion and amplification of one or more forces required at each driver element in the plurality of driver elements; and drive the plurality of amplifiers with the converted and amplified forces required at each driver element in the plurality of driver elements.

12. The system of claim 11, wherein the audio layer is laminated onto at least a portion the functional portion of the display.

13. The system of claim 11, wherein the functional portion of the display is selected from the group consisting of a liquid crystal display (LCD), a light-emitting diode display (LED), and an organic light-emitting diode display (OLED).

14. The system of claim 11, wherein a spacer element can exist between the audio layer and the functional portion of the display.

15. The system of claim 11, wherein at least a portion of the audio layer is positioned between a touch panel and at least a portion of the functional portion of the display.

16. The system of claim 11, wherein the plurality of driver elements are positioned on the panel in a predetermined arrangement, and wherein the pre-determined arrangement comprises a uniform grid-like pattern on the panel.

17. A method of virtual source generation for the generation of an audio scene by effecting spatial and temporal control of the vibrations of a panel, comprising receiving an audio signal;

receiving one or more distance cues associated with a virtual acoustic source, wherein the virtual acoustic source is representative of an acoustic source behind a panel;

computing one or more acoustic wave fronts at one or more predetermined locations on the panel;

computing one or more modal accelerations from the audio signal and one or more distance ques and acoustic wave fronts;

computing, using a frequency domain plate bending mode response, one or more modal forces needed to produce the one or more modal accelerations;

determining a response associated with a discrete-time filter corresponding to the frequency domain plate bending mode response;

summing the one or more modal forces to determine one or more forces required at each driver element in an array of driver element;

performing a multichannel digital-to-analog conversion and amplification of the force required at each driver element in an array of driver elements; and driving a plurality of amplifiers with the converted and amplified forces required at each driver element in an array of driver elements.

18. The method of claim 17, wherein a left channel, a center channel, and a right channel are excited by the plurality of driver elements in order to produce a surround sound or a stereo sound.

19. The method of claim 17, wherein the audio signal is spatially tied to one or more portions of at least portion of an image and video associated with a display.

20. The method of claim 17, wherein the method is used for spatial and temporal control of the vibrations of a panel, wherein the plurality of drive elements mounted to the backside of the panel.

* * * * *